US005954207A

United States Patent [19]

Yamashita et al.

[11] Patent Number: 5,954,207

[45] **Date of Patent: *Sep. 21, 1999**

[54] METHOD AND APPARATUS FOR SORTING SHEETS IN A PREDETERMINED SEQUENTIAL ORDER

[75] Inventors: Taichiro Yamashita, Tsuchiura; Kazushi Yoshida, Ibaraki-ken; Yasunori Hamada, Tsuchiura; Junichi Tamamoto, Ibaraki-ken; Toshihiko Tajiri, Owariasahi, all of Japan

[73] Assignee: Hitachi, Ltd., Tokyo, Japan

[ * ] Notice: This patent is subject to a terminal disclaimer.

[21] Appl. No.: 08/911,734

[22] Filed: Aug. 15, 1997

Related U.S. Application Data

[63] Continuation of application No. 08/576,688, Dec. 21, 1995, Pat. No. 5,740,921.

[30] Foreign Application Priority Data

Dec. 22, 1994 [JP] Japan ..... 6-319766

[51] Int. Cl.[6] ..... B07C 5/36

[52] U.S. Cl. ..... 209/584; 209/900

[58] Field of Search ..... 209/583, 584, 209/900

[56] References Cited

U.S. PATENT DOCUMENTS

| | | | |
|---|---|---|---|
| 4,106,636 | 8/1978 | Ouimet et al. . | |
| 4,247,008 | 1/1981 | Dobbs | 209/589 |
| 5,097,959 | 3/1992 | Tilles | 209/584 |
| 5,353,938 | 10/1994 | LaGrange et al. | 209/900 |
| 5,363,971 | 11/1994 | Weeks et al. | 209/584 |

FOREIGN PATENT DOCUMENTS

| | | |
|---|---|---|
| 43 02 231 A1 | 8/1994 | Germany . |
| A-63-287584 | of 0000 | Japan . |
| WO 93/02810 | 2/1993 | WIPO . |

*Primary Examiner*—Boris Milef

*Attorney, Agent, or Firm*—Antonelli, Terry, Stout & Kraus, LLP

[57] ABSTRACT

A small-size apparatus for sorting sheets or the like can form a delivery route by repeating sorting operation and prevent an overflow of sheets or the like. To this end, auxiliary sorting compartments are provided in accumulating means in the sorting operation for the first time, and when an overflow occurs, the allocated sorting compartments are shifted each by one compartment to the side of the auxiliary sorting compartment. In the first-time sorting operation, destination codes 15 and thicknesses are stored in memory, and by the destination codes and thicknesses stored, overflow is predicted, a plurality of sorting compartments are allocated. By this arrangement, the sheets or the like can be prevented from overflowing, so that those sheets or the like which are rejected need not be manually added afterwards, and the efficiency of the sorting work can be improved.

20 Claims, 13 Drawing Sheets

METHOD AND APPARATUS FOR SORTING SHEETS IN A PREDETERMINED SEQUENTIAL ORDER

This application is a continuation of Ser. No. 08/576,688 filed Dec. 21, 1995 now U.S. Pat. No. 5,740,921.

BACKGROUND OF THE INVENTION

The present invention relates to a method and an apparatus of sorting sheets or the like for reading destination codes in bar codes, for example, provided on paper sheets or the like, such as postal matter, and classifying the thrown-in sheets or the like according to destination codes, and more particularly to a method and an apparatus of sorting sheets or the like, which are capable of forming a delivery route of postal matter by sequencing the postal matter in the order of delivery according to destinations.

A system for sorting sheets or the like for delivery disclosed in JP-A-63-287584 is one of the apparatus for sequencing the thrown-in sheets or the like in the order specified by destination codes.

This conventional technique inputs delivery destinations of sheets or the like and sorts them into destination districts according to the inputted delivery destinations. In this sorting process, the destinations and the numbers of sheets or the like are stored in memory sorted into the destination districts. Then, the destinations are sequenced or rearranged in the order of delivery, and again stored in memory. Subsequently, the sheets sorted into the destination districts are taken out once, and sent to the supply means and the delivery destinations are read again, and by collating with the destinations arranged in the order of delivery in the memory, the sheets are sorted in the order of delivery.

In the above-mentioned prior art, when forming a delivery route, it is necessary to take out the sheets or the like such as mails classified once in the sorter, and bring them back to the supply means without changing their order. To this end, the sorted sheets or the like are transported from the sorter to the supply means. In this method, in order to supply the sheets sorted and accumulated in the sorter back to the supply means, the sheets need to be moved for three to six meters from the sorter to the supply means.

SUMMARY OF THE INVENTION

Supposing that the number of mails for a mailman is about 1000, the weight of mails amount to about 10 kg in total, and therefore it is necessary to provide a mail basket in the vicinity of the sorter, for example, put the mails into the basket taking care so as not to disrupt their order, and move the basket to the vicinity of the supply means, and supply the mails sequentially. This work is troublesome, and what is worse, if any mistake is made about the order of the mails when putting in and taking out of the basket, a delivery route cannot be formed correctly.

The object of the present invention is to provide an apparatus for sorting sheets or the like, which is capable of improving the efficiency of forming the delivery route of sorted mails, and to provide a small-size apparatus which can be installed in a small post office.

In order to achieve the above object, the method for sorting sheets or the like according to the present invention uses any of the following arrangements:

(1) A method for sorting sheets or the like comprising the steps of:

separating, by separating means, a sheet or the like from a plurality of sheets or the like supplied from supply means holding the sheets or the like in upright position, and sending the sheet or the like;

after the sheet or the like is transferred, reading a destination code of the sheet or the like by destination code reading means for reading the destination code previously attached to the sheet or the like, and storing the destination code in a first memory unit;

storing in a second memory unit a sorting setting showing correspondence between the destination codes and a plurality of sorting compartments in accumulating means;

classifying and throwing the sheet or the like into one of the sorting compartments of the accumulating means according to the destination code;

performing a series of sorting steps of sequentially sorting and accumulating according to the sorting setting the sheets or the like in upright position into the plurality of sorting compartments of the accumulating means, located above and adjacent to the supply means;

after the sorting operation, moving the accumulated sheets or the like from the accumulating means again to the feed means;

subsequently, rearranging or sequencing the sheets or the like in a specified order according to the destination codes by repeating the sorting operation;

determining a sorting setting showing correspondence between destination codes in the sorting operation for a second time and beyond and the sorting compartments by using the destination codes stored in the sorting operation for a first time, and storing the sorting setting in the second memory unit; and performing the sorting operation for the second time and beyond according to the sorting setting stored in the second memory unit.

In this case, it is effective if the above-mentioned sorting method further comprises the steps of providing an auxiliary sorting compartment adjacent to the sorting compartments and abnormality detecting means for detecting an abnormality signal when any sorting compartment becomes unable to accumulate the sheets or the like;

stopping sorting and throwing the sheets or the like into allocated sorting compartments when the abnormality signal is detected during the sorting operation for the first time;

changing the sorting setting, which has been allocated to all the sorting compartments from a sorting compartment closest to the auxiliary sorting compartment to a sorting compartment where the abnormality signal was detected, and then allocating the changed sorting setting to all the sorting compartments from the auxiliary sorting compartment to a sorting compartment adjacent on the auxiliary sorting compartment to the sorting compartment where the abnormality signal was detected, and storing the changed sorting setting in the second memory unit; and continuing the sorting operation according to the sorting setting stored in the second memory unit.

In this case, the sorting method should preferably be such that the sorting setting is to set a plurality of the auxiliary sorting compartments and also provide a plurality of sorting compartments between the auxiliary sorting compartments, and the sorting method should preferably further comprises the steps of selecting one of a plurality of groups of destination codes, and providing sorting information inputting means for inputting a specified sequencial order previously determined for each group of destination codes and also inputting the sorting setting, wherein the way in which the auxiliary sorting compartments and the sorting compartments are arranged in the sorting setting differs with the different groups of destination codes.

(2) A method and an apparatus for sorting sheets or the like comprising the steps of:

separating by separating means a sheet or the like from a plurality of sheets or the like supplied from supply means holding the sheets or the like in upright position, and transferring the sheet or the like;

after the sheet or the like is transferred, reading a destination code of the sheet or the like by destination code reading means for reading the destination code previously attached to the sheet or the like, and storing the destination code in a first memory unit;

storing in a second memory unit a sorting setting showing correspondence between the destination codes and a plurality of sorting compartments in accumulating means;

classifying and throwing the sheet or the like into one of the sorting compartments of the accumulating means according to the destination code;

performing a series of sorting steps of sequentially sorting and accumulating the sheets or the like in upright position into the plurality of sorting compartments of the accumulating means, located above and adjacent to the supply means, according to the sorting setting;

after the sorting operation, moving the accumulated sheets or the like from the accumulating means again to the feed means;

subsequently, sequencing the sheets or the like in a specified order according to the destination codes by repeating the sorting operation;

storing in a third memory unit the number of sheets or the like to be sorted and thrown into each of the sorting compartments in a third memory unit;

obtaining the number of the sheets or the like sorted and thrown into each sorting compartment in a sorting operation for a second time from the destination codes stored in the first memory unit in the sorting operation for a first time, and storing the obtained number of the sheets or the like in the third memory unit;

arranging the sorting setting so as to allocate a plurality of consecutive sorting compartments to accommodate the number of sheets or the like as applicable sorting compartments when the number of sheets or the like exceeds a specified value in any of the sorting compartments, and storing the sorting setting in the second memory unit; and performing the sorting operation for the second time and beyond according to the sorting setting.

In this case, the sorting method should preferably be such that when the set number of sorting compartments is greater than the total number of sorting compartments provided in the accumulating means, in the sorting setting provided such that a plurality of sorting compartments are allocated because the number of sheets or the like stored in the third memory unit is greater than a specified number, the sorting setting is changed so that the set number of sorting compartments is smaller than or equal to the total number of sorting compartments by reducing the allocated sorting compartments by sequentially selecting the sorting compartments with smaller excess numbers of sheets or the like over the specified number.

(3) A method and an apparatus for sorting sheets or the like comprising the steps of:

separating by separating means a sheet or the like from a plurality of sheets or the like supplied from supply means holding the sheets or the like in upright position, and transferring the sheet or the like;

after the sheet or the like is transferred, reading a destination code of the sheet or the like by destination code reading means for reading the destination code previously attached to the sheet or the like, and storing the destination code in a first memory unit;

storing in a second memory unit a sorting setting showing correspondence between the destination codes and a plurality of sorting compartments in accumulating means;

classifying and throwing the sheet or the like into one sorting compartment of the accumulating means according to the destination code;

performing a series of sorting steps of sequentially sorting and accumulating the sheets or the like in upright position into the plurality of sorting compartments of the accumulating means, located above and adjacent to the supply means, according to the sorting setting;

after the sorting operation, moving the accumulated sheets or the like from the accumulating means again to the feed means;

subsequently, sequencing the sheets or the like in a specified order according to the destination codes by repeating the sorting operation;

measuring a thickness of sheets or the like by thickness measuring means located midway through sheets-or-the-like transfer means connecting the separating means and accumulating means;

storing in the first memory the destination codes and thicknesses of sheets or the like associated with the codes;

storing in a third memory the destination codes and thicknesses of the sheets or the like sorted into each sorting compartment;

obtaining the destination codes and thicknesses of the sheets or the like, sorted into each sorting compartment in sorting operation for the second time, from the destination codes and thicknesses stored in the first memory unit in sorting operation for the first time, and storing the destination codes and thicknesses in the third memory;

when a total thickness of sheets or the like exceeds a specified thickness in any sorting compartment, arranging the sorting setting so that a plurality of consecutive sorting compartments capable of accommodating sheets or the like of the thickness are allocated as applicable sorting compartments, and storing the sorting setting in the second memory unit; and performing the sorting operation for the second time and beyond according to the sorting setting.

In this case, the sorting method should preferably be such that if the sorting setting is provided such that a plurality of sorting compartments are allocated because a total of the thicknesses of sheets or the like stored in the third memory unit exceeds a specified thickness, when the set number of sorting compartments is greater than the total number of sorting compartments provided in the accumulating means, the sorting setting is arranged so that the set number of sorting compartments is greater than or equal to a total number of the sorting compartments in the accumulating means by reducing the allocated sorting components by sequentially selecting sorting compartments with smaller excess numbers over the specified thickness, and then the sorting operation for the second time and beyond are performed. The sorting method should be effective if it further comprises the steps of:

providing, in an apparatus for sorting sheets or the like, sequencing means for sequencing the destination codes stored in the third memory unit and a fourth memory unit for storing destination codes of sheets or the like to be rejected;

deciding sheets or the like to be rejected in the descending order of thickness until the number of the set sorting compartments becomes smaller than or equal to a total number of the sorting compartments in the accumulating means;

storing in the fourth memory unit the destination codes of the sheets or the like to be rejected, and then performing the sorting operation for the second time and beyond;

when a destination code read by the destination code reading means is stored in the fourth memory unit, rejecting that sheet or the like. The sorting method should preferably be such that the thickness measuring means measures the length of the sheets or the like midway through the transfer means, and specifies predetermined thicknesses corresponding to measured lengths.

In any of the above aspects (1) to (3), it is effective if the sheets or the like sorted and accumulated in the accumulating means are moved to the supply means while keeping their order unchanged, and they are again separated one by one by the separating means.

DETAILED DESCRIPTION OF THE PREFERRED EMBODIMENTS

Embodiments of the present invention will be described with reference to the accompanying drawings.

Figure 1:
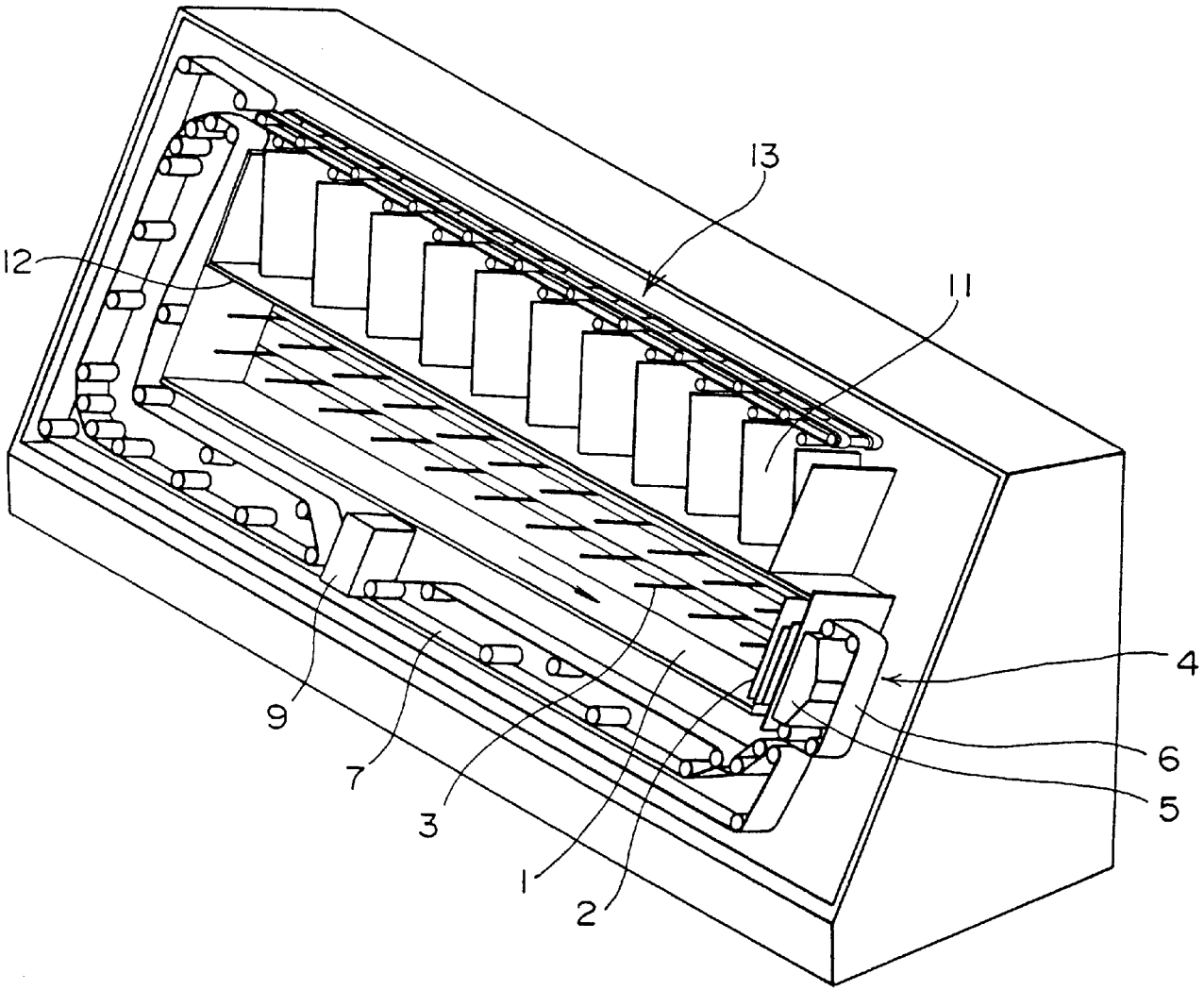
FIG. 1 is a perspective view showing an embodiment of the apparatus for sorting sheets or the like according to the present invention.

FIG. 1 is a perspective view showing an embodiment of the apparatus according to the present invention. In FIG. 1, feed means can hold a plurality of paper sheets or the like 2, and forks 3 can move by pushing in the direction of the arrow the sheets or the like 2 supported movably in the direction of the arrow along the supply means 1.

Separating means 4 can separate only a sheet at the right end (on the drawing) out of the sheets or the like 2 placed on the feed means 1 and transfer it downwards. The means for separating sheets or the like is generally of a suction type utilizing a vacuum chucking belt. Only a sheet nearest to a suction belt 6 can be separated out of the sheets or the like 2 and transferred by having a sheet held to a chucking belt 6 by a negative pressure of a vacuum chamber 5 and rotating the chucking belt 6 by drive means such as an electric motor.

Transfer means 7 transfers the sheets or the like 2, which have been separated by the separating means 4, with the front and reverse sides held by belts.

Destination code reading means 9 reads destination codes such as bar codes put on the sheets or the like 2. The destination codes may be bar codes, printed numbers and characters, or handwritten numbers and characters, in other words, codes which can be read by the reading means 9.

The accumulating means 11 is the means to accumulate the sheets or the like 2 which have been read, comprises a bottom plate 12 and is installed adjacent to and on top of the feed means 1. The accumulating means 11 has its inside divided into a plurality of sorting compartments, which are so formed as to hold the sheets or the like 2 in the same position as they are in the supply means 1. The classifying means 13 classifies and throws the sheets or the like 2 into the sorting compartments of the accumulating means 11.

Figure 2:
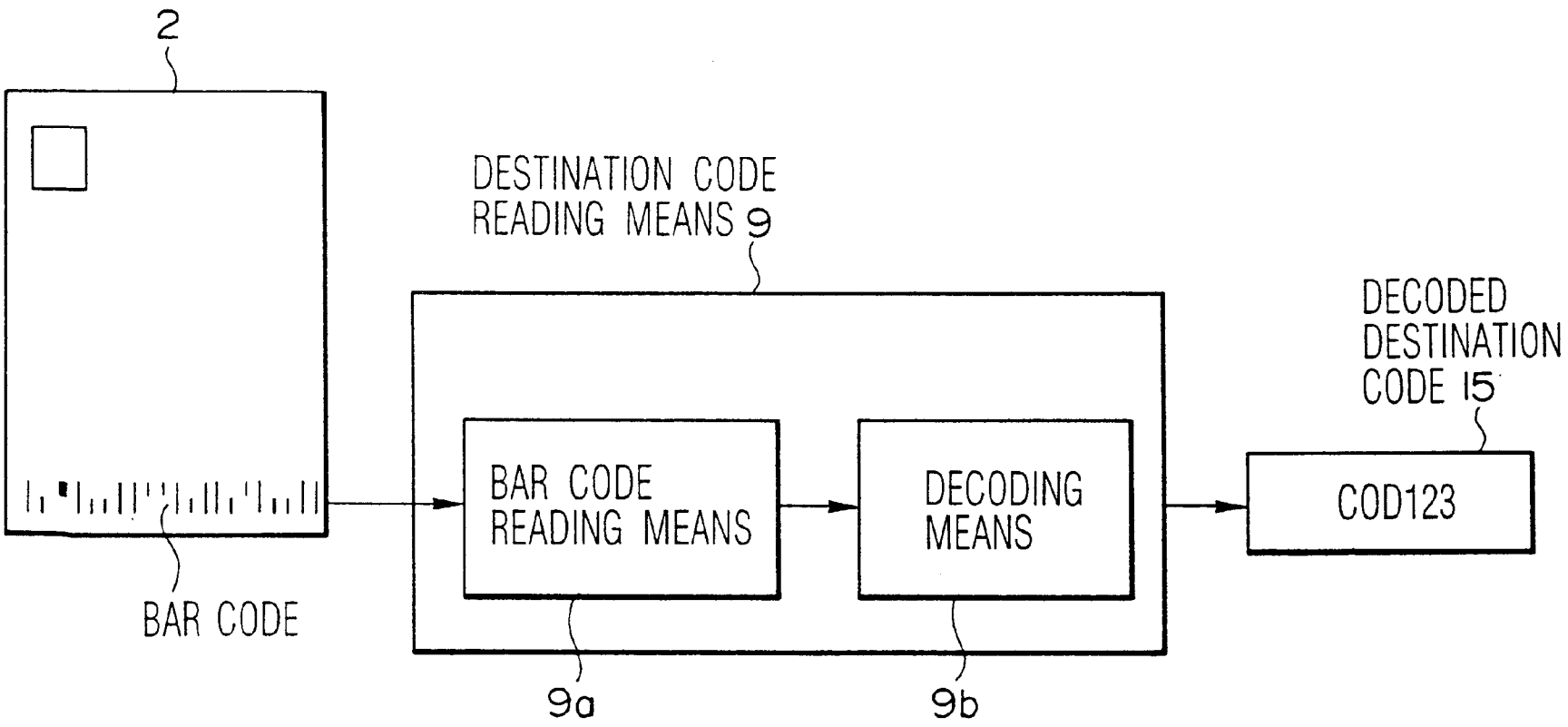
FIG. 2 is a diagram showing an example of composition of a destination code and a destination code reading means, in cross sectional view, which is a component of an apparatus for sorting sheets or the like according to the present invention.

FIG. 2 is a diagram showing examples of a destination code on a sheet and the structure of destination code reading means 9, which is a component of the present invention. The destination code is a bar code BAR to represent numbers or symbols by long and short bars. The bar code BAR is read by bar code reading means 9*a,* and decoded by decoding means 9*b* into a destination code 15 expressed by ordinary numbers and symbols.

Figure 3:
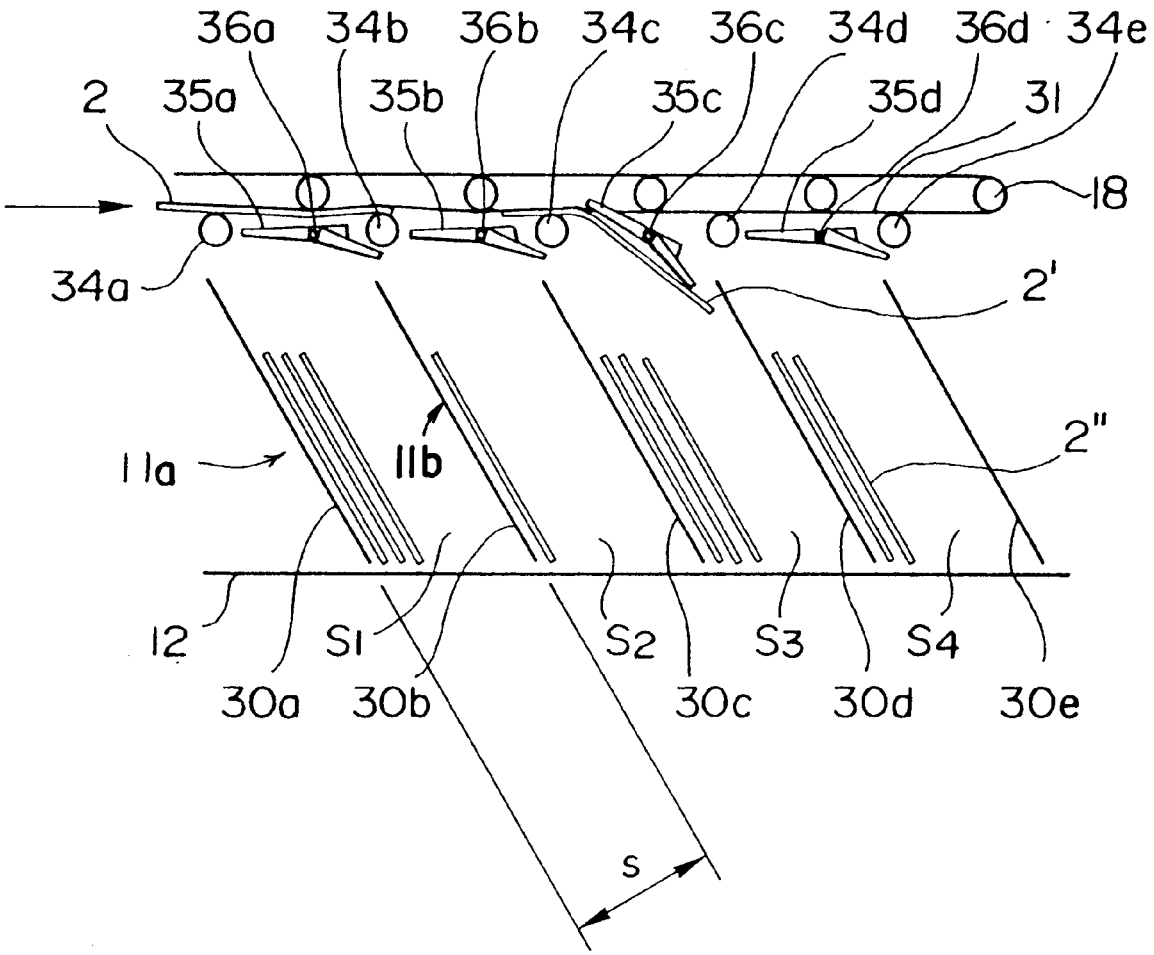
FIG. 3 is a front view showing an example of the structure of accumulating means and classifying means, which are components of an apparatus for sorting sheets or the like according to the present invention.

FIG. 3 is a side view showing an example of the accumulating means 11 and the classifying means 13, which are components of the present invention. In FIG. 3, the partitions 30*a,* 30*b,* 30*c,* divide the inside of the accumulating means 11 and separate the sorting compartments S0, S1, S2 . . . . The belt 31 forms a part of a transfer path 7, and transfers the sheets or the like 2 in the direction of the arrow. A pulley 18 drives the belt 31, and rollers 34 hold the sheets or the like 2 between themselves and the belt 31.

Gate diverters 35 classify into specified sorting compartments S0, S1, S2 . . . the sheets or the like 2 sent in the arrow direction as they are held between the belt and the rollers 34, and can rotate for a specified angle about the centers of rotation 36. If a single belt 31 is used, the gate diverters 35 are mounted on either side of the belt 31 and at locations where the gate diverters 35 do not contact the belt 31 when the diverters 35 rotate about the centers of rotation 36. If two parallel belts 31 are used, the diverters 35 are placed between the two belts 31 at locations where the diverters 35 rotate about the centers of rotation 36.

To show an example, when the gate diverters 35 are substantially in parallel with the belt 31 as the diverters 35*a* and 35*b* are in FIG. 3, the sheets or the like 2 pass between the diverters 35*a* and 35*b* and are transferred to the diverter 35*c*. As the diverter 35*c* is rotated about the rotation center 36*c* for a specified angle and the leading end of the diverter 35*c* moves away from the belt 31 and turns closer towards the pulley 18, a sheet or the like 2' passes beneath the deflector gate 35*c* and falls into the sorting compartment S3.

If the above-mentioned mechanism is provided as many as a necessary number of sorting compartments in the longitudinal direction of the first accumulating means 11*a* and the second accumulating means 11*b,* to give an example, the first accumulating means 11*a* and the second accumulating means 11*b* can be respectively divided into five sorting compartments. The sheets or the like 2" thrown into the respective sorting compartments are accumulated in substantially upright position and leaning on the partitions 30 of the sorting compartments S0 to S9.

Figure 4:
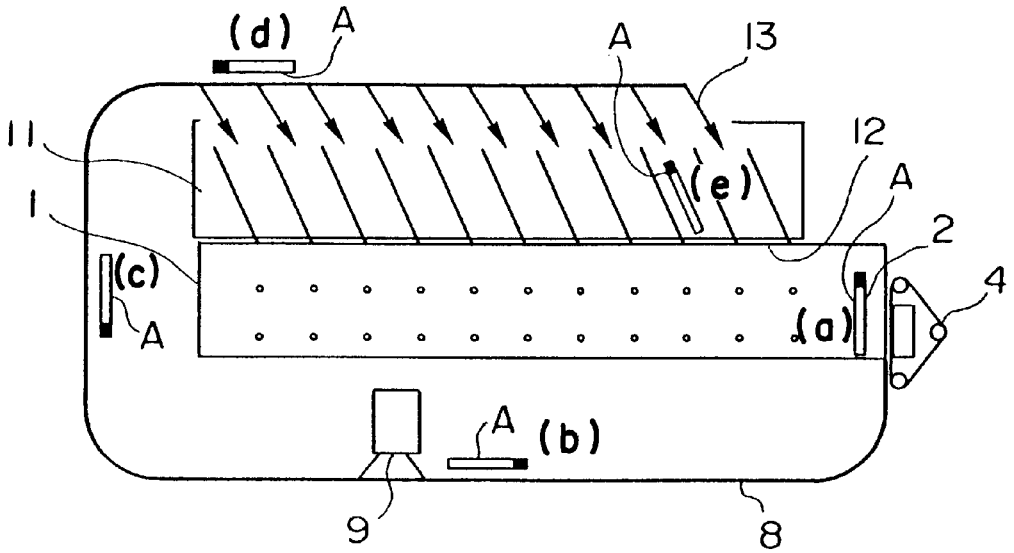
FIG. 4 is a schematic diagram showing the structure of the embodiment of the apparatus for sorting sheets or the like according to the present invention.

Then, referring to FIGS. 4 and 5, description will be made of examples of structures of the supply means 1 and the accumulating means 11, and the transfer means 7 and the reading means 9. FIG. 4 is a schematic diagram showing the structure of the first embodiment of the apparatus for sorting sheets or the like according to the present invention. The transfer means 7 is indicated by a solid line showing only the moving path of the sheets or the like 2.

The leading end of a sheet or the like 2 is indicated by a dark portion, the side on which a destination code 15 is printed is called the face A facing the side opposite the side where there is the first separating means 4*a*. A sheet or the like 2 (a) is separated by the separating means 4, transferred downwards and delivered to the transfer means 7 (the sheet b). The sheet or the like 2 being transferred has its destination code read by the destination code reading means 9 (the sheet c). At this stage, the face A is facing up, and the destination code reading means 9 is located above the transfer means and reads the destination code 15 from above the sheet or the like 2.

Subsequently, the sheet or the like 2 is transferred in the posture as shown at (d), and according to the contents of the destination code 15 printed on the face A of the sheet or the like 2, the sheet is accommodated into one of the sorting compartments of the accumulating means 11, with which a series of sorting steps is finished. The sheet or the like 2 at this time is in the same posture as shown at (a) when it is held by the supply means 1 as indicated by (f).

By moving the sheet or the like 2 from the accumulating means 11 to the supply means 1 and supplying it again to the separating means 4, the sorting operation of the sheet or the like can be repeated.

Figure 5:
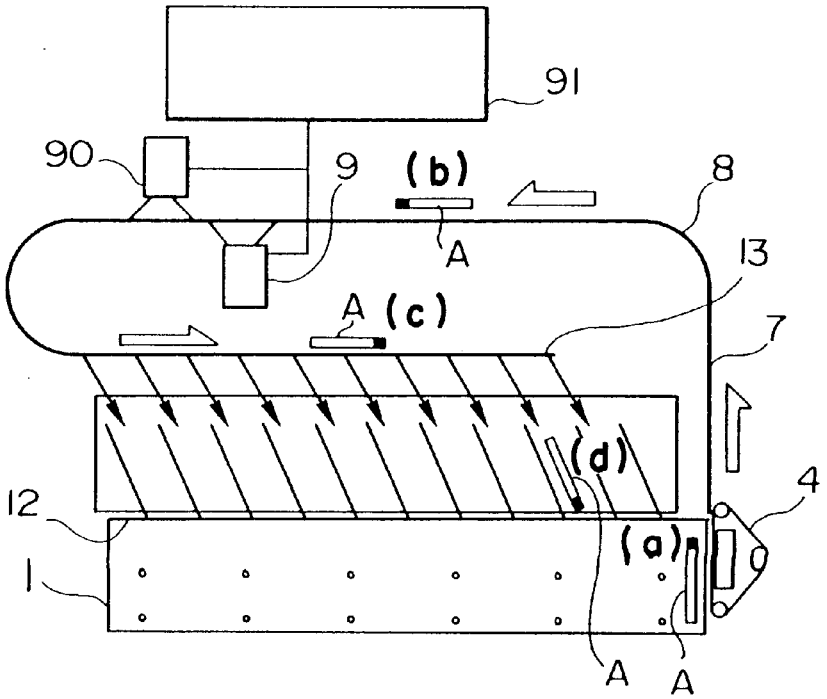
FIG. 5 is a schematic diagram showing the structure of another embodiment of the apparatus for sorting sheets or the like according to the present invention.

FIG. 5 is a schematic diagram showing the structure of another embodiment of the sheet or the like sorting apparatus according to the present invention. The differences from the first embodiment are that the transfer direction of the sheet or the like separated and fed from the feed means 1 is upwards and that there are provided first destination code reading means 9, located below the transfer means 7, for reading destination codes 15 from under the sheets or the like 2, second destination code reading means 90, located above the transfer means 7, for reading destination codes from above the sheets or the like 2, and selecting means 91 for selectively using the first destination reading means 9 or the second destination reading means 90.

Also in FIG. 5, if the direction of the sheets or the like 2 is indicated as in FIG. 4, the sheets or the like 2 are transferred through the points in the order of (a), (b) and (c) passing through the transfer path 7 and a juncture 8, and accumulated in the accumulating means 11, where the sheets or the like 2 are in the up side down, reverse-side up position (d). Therefore, in sorting for the second time, the destination code on the surface is read by the second destination code reading means 90.

According to the above structure, each time a series of sorting operation is repeated, by selecting the first destination code reading means 9 or the second destination code reading means 90 by selecting means 91, the sorting operation of sheets or the like 2 can be repeated.

Figure 6:
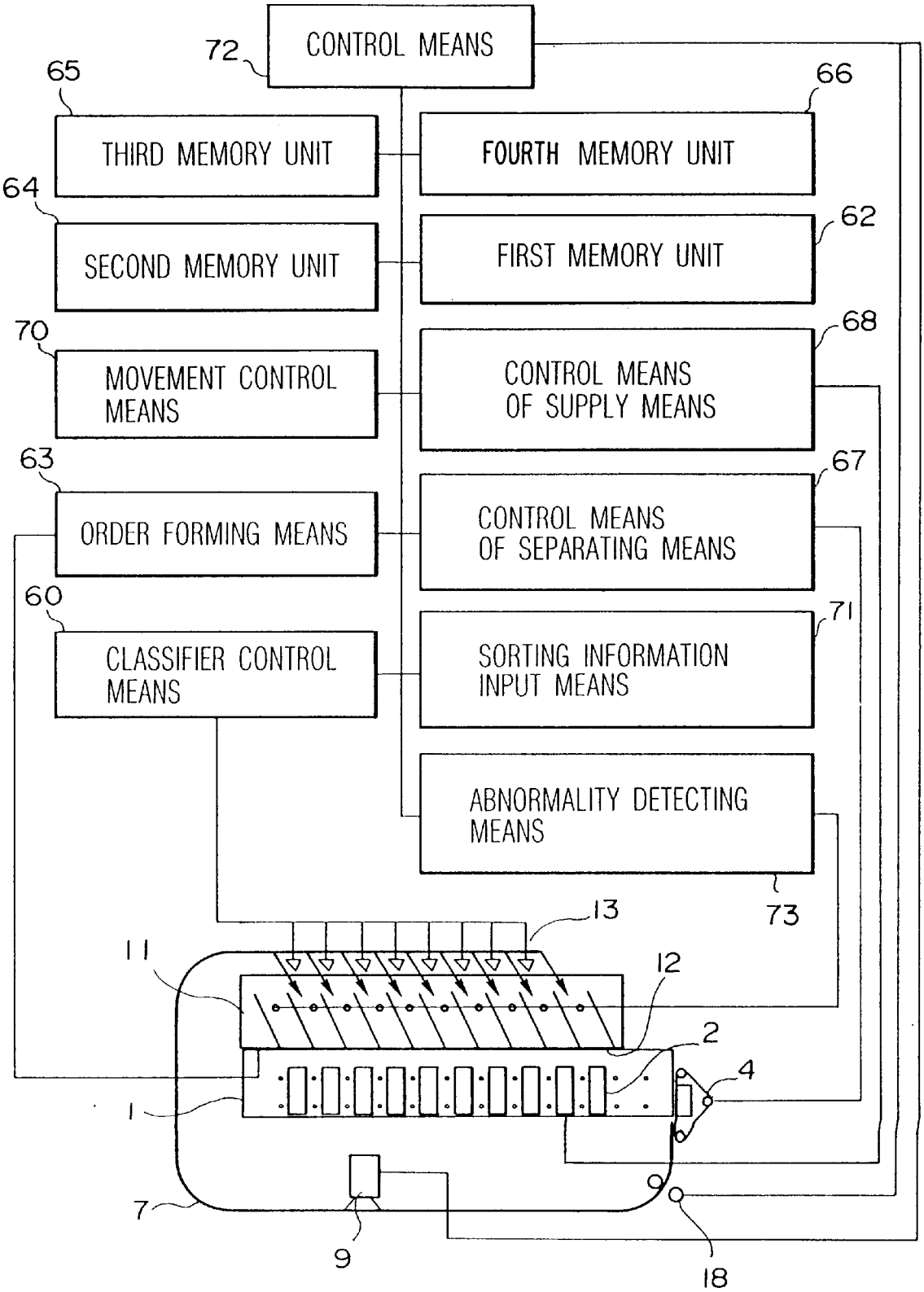
FIG. 6 is a block diagram showing the structure of the apparatus for sorting sheets or the like according to the present invention.

FIG. 6 is a block diagram showing the arrangement of an embodiment of the apparatus for sorting sheets or the like according to the present invention. In FIG. 6, sorting control means 60 controls the classifying means 13, and a first memory unit 62 can store a destination code 15 (FIG. 2) read by the destination code reading means 9 and the thickness of a sheet or the like 2 obtained by thickness detecting means 18. Sequencing means 63 can sequence or rearrange the destination codes and the thicknesses of sheets or the like in the order of destination codes. Second memory unit 64 can store the respective digits of destination codes to be sorted and the corresponding sorting compartments in the accumulating means 11. Third memory unit 65 can store the destination codes and the thicknesses of sheets or the like 2 in relation to the corresponding sorting compartments. Fourth memory unit 66 can store the destination codes of the sheets or the like which need to be subjected to a reject process.

Separating means control means 67 controls the separating means 4. Supply means control means 68 controls the supply means 1. Movement control means 70 can move the sheets or the like 2, sorted and accumulated in the accumulating means 11, to the feed means 1 while maintaining the order in which they are accumulated. An embodiment of this means can be realized by extracting the bottom plate 12 from the accumulating means 11 toilet the sheets or the like 2 fall into the supply means 1. Sorting information input means 71 can input delivery sorting information about the sheets or the like 2.

Control means 72 can control the destination code reading means 9, the sorting control means 60, the separating means control means 67, the supply means control means 68, the movement control means 70, and the sorting information input means 71.

By referring to FIGS. 7 to 13, description will now be made of sorting (here this means the delivery route sequencing operation) of the sheets or the like 2 by the arrangement of the embodiment of the present invention. It ought to be noted that, for description, the contents of destination codes 15 are represented by three-digit numbers of 000 to 999, and to differentiate from other numbers, COD000 to COD999 are used. One thousand sheets or the like 2 assigned destination codes 15 and arranged in an irregular order are to be sequenced or rearranged in the order of destination codes 15 (delivery route sequencing operation).

To make description simple, the sheets or the like 2 are set to be a quantity that can be thrown into the feed means at a time, and the sheets or the like thrown into the sorting compartments are set not to exceed the capacity of each sorting compartment. Description of each component of the embodiment is omitted here, and description will only be made of a list of destination codes 15 in the process of sequencing the sheets or the like 2.

In FIGS. 7 to 13, for description, the transfer means 7 for the sheets or the like is indicated schematically by only a solid line. The accumulating means 11 is divided into ten sorting compartments S0 to S9, and the sorting compartments are associated with numbers 0 to 9. The sheets or the like that have arrived are thrown into the sorting compartments corresponding to the destination codes 15.

Figure 7:
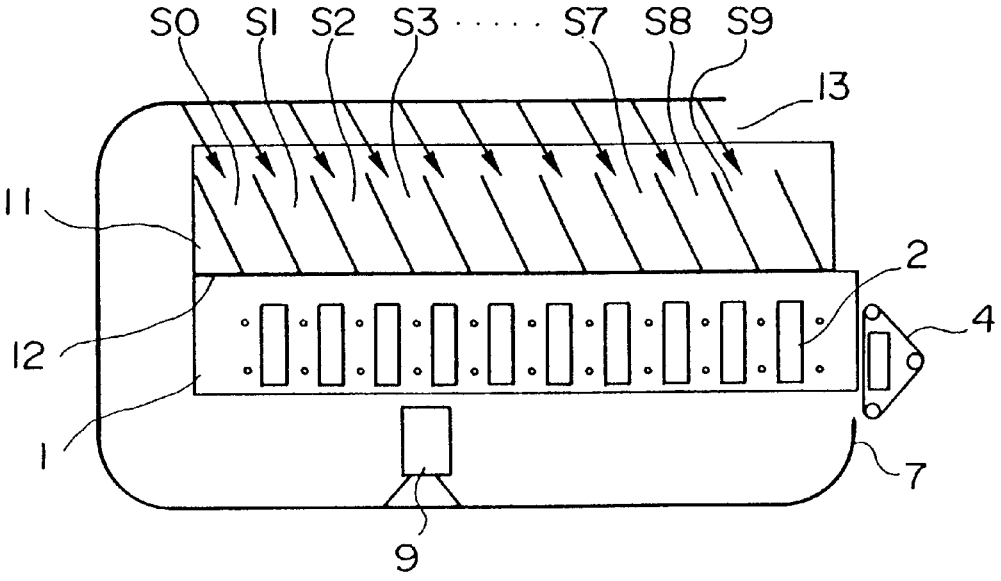
FIG. 7 is an explanatory diagram showing an example of a delivery route sequencing operation in the apparatus for sorting sheets or the like according to the present invention.

FIG. 7 shows the condition that 1000 sheets or the like 2, which have been given three-digit destination codes 15 from COD000 to COD999, are supplied to the feed means 1. The sheets or the like are sequenced irregularly, with the rightmost sheet 2 being in contact with the separating means 4. As the vacuum chucking belt 6 of the separating means 4 rotates, only one rightmost sheet is separated, and delivered to the transfer means 7. The previously given destination code 15 on the sheet or the like 2 being transferred, that is, any value from COD000 to COD999 is read by the destination code reading means 9.

Figure 8:
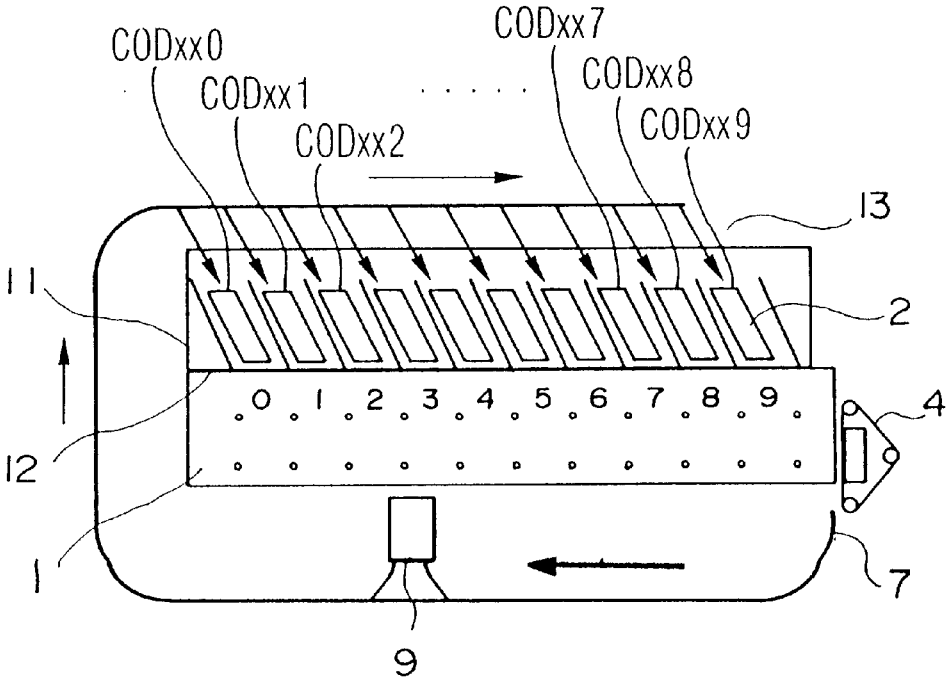
FIG. 8 is an explanatory diagram showing another example of the delivery route sequencing operation in the apparatus for sorting sheets or the like according to the present invention.

In processing at the first stage of sorting, as shown in FIG. 8, the sorting compartments S0 to S9 in the accumulating means 11 are associated with numbers 0 to 9. The sheet or the like 2 whose destination code 15 has been read by the first destination code reading means 9 is thrown into a sorting compartment which has the same assigned number as the number at the first digit, that is, at unit's place of the destination code 15. For example, if the digit at unit's place of the destination code is "2", the sheet or the like 2 is thrown into the sorting compartment of number 2, or S2.

When all sheets or the like 2 have been thrown likewise into the sorting compartments S0 to S9 by sorting by the digit at unit's place of destination codes 15, the sheets or the like which have the same number only at unit's place are collected in each sorting compartment. A destination code CODXX0 designates sheets or the like 2 which have 0 at unit's place but any other number from 0 to 9 at 10's place and 100's place. Similar description can be applied to destination codes CODXX1 and CODXX2.

When the first stage processing is finished as described above, all sheets or the like 2 are moved into the feed means 1 without disrupting the orders of the sheets as they are arranged in the sorting compartments S0 to S9 of the accumulating means 11. An embodiment of this means can be realized by extracting the bottom plate 12 from the accumulating means 11 to let all the sheets or the like 2 fall into the feed means 1.

Figure 9:
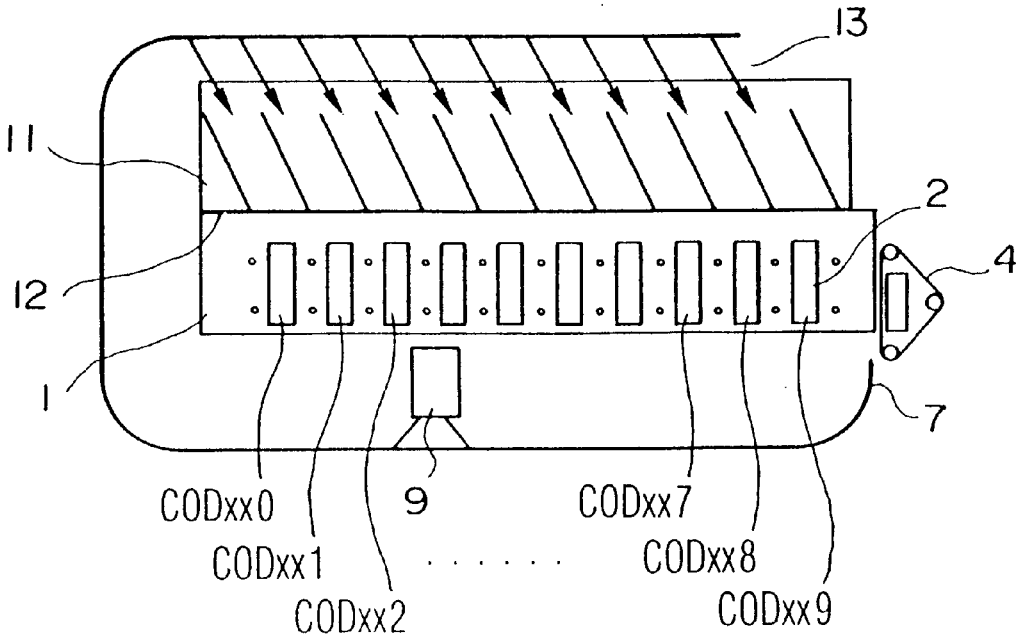
FIG. 9 is an explanatory diagram showing yet another example of the delivery route sequencing operation in the apparatus for sorting sheets or the like according to the present invention.
Figure 10:
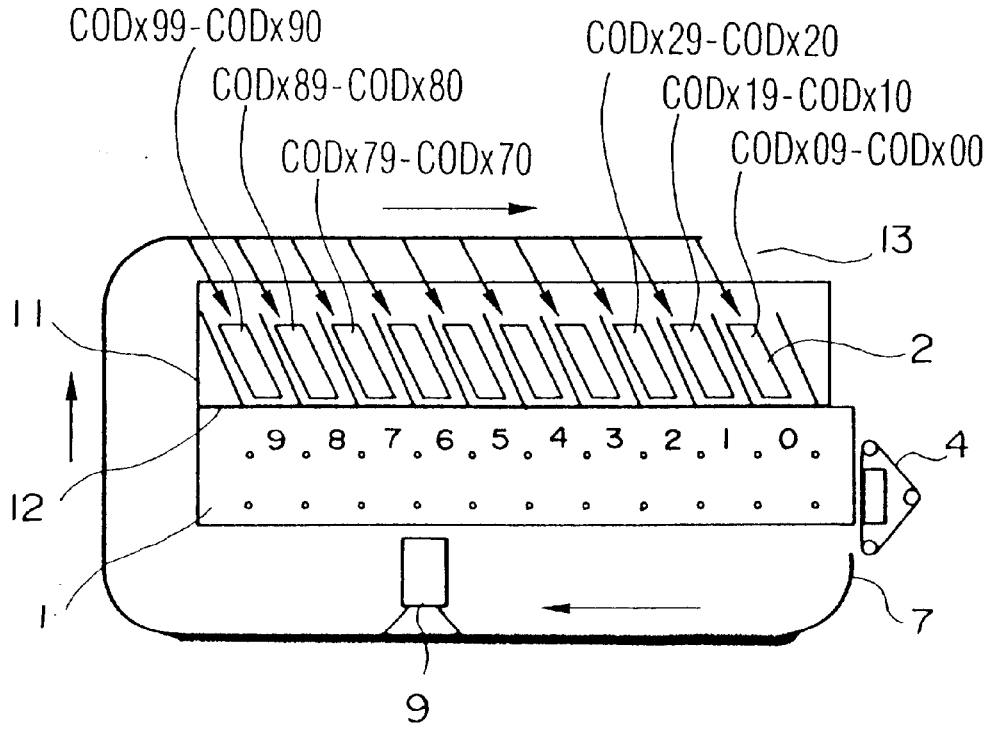
FIG. 10 is an explanatory diagram showing another example of the delivery route sequencing operation in the apparatus for sorting sheets or the like according to the present invention.

FIG. 9 shows the condition after the sheets or the like 2 have been moved. Under this condition, if the sheets or the like 2 are moved from the feed means 1 to the separating means 4, only the rightmost sheet is separated again, and can be transferred along the transfer means. From this condition, the second stage processing is started. In the second stage processing, as shown in FIG. 10, the sorting compartments S0 to S9 are associated sequentially with numbers 0 to 9. As shown in FIG. 9, the sheets or the like 2 having 9 at unit's place are sent to the separating means 4, their destination codes 15 are read by the destination code reading means 9, and the sheets or the like are thrown into the sorting compartments whose numbers correspond to the numbers at 10's place (second digit) of their destination codes 15. Likewise, the sheets which have 8 to 0 at unit's place of their destination codes are thrown into the sorting compartments S0 to S9 corresponding to the numbers at the second digit, or at 10's place of their destination codes.

Figure 11:
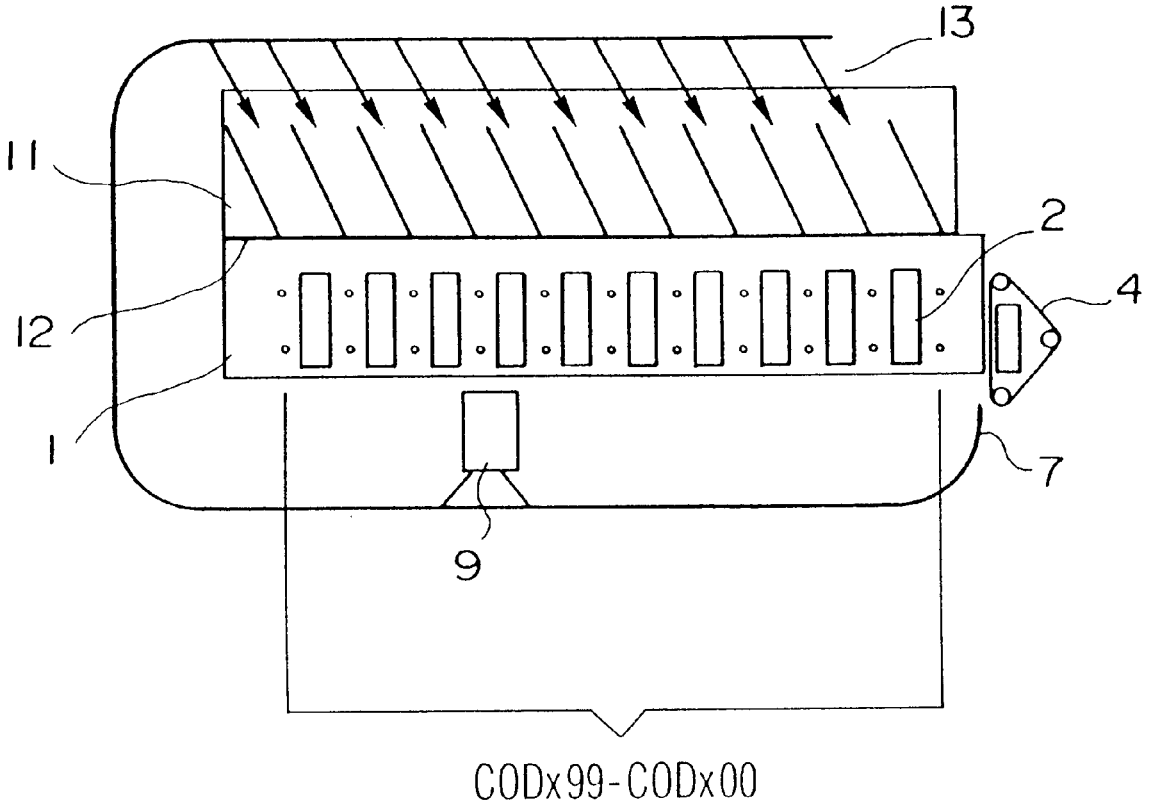
FIG. 11 is an explanatory diagram showing still another example of the delivery route sequencing operation in the apparatus for sorting sheets or the like according to the present invention.

As a result, the sheets or the like 2 which have 99 as the last two digits are accumulated in the leftmost position, the sheets or the like which have 98 as the last two digits are accumulated in the position next to the leftmost ones, and likewise, the sheets or the like 2 which have 90 as the last two digits are thrown into the rightmost position. However, the numbers at 100's place may be completely random. In the next sorting compartment S1, the sheets or the like 2 which have 89 as the last two digits are accumulated in the leftmost position, and those having 88 as the last two digits are accumulated in the position next to the leftmost ones, and likewise, the sheets or the like 2 having 80 as the last two digits are accumulated in the rightmost position in the sorting compartment S1. Similar description applies to the partitions S2 to S9, the numbers at 100's place of destination codes are random, but those sheets having larger numbers as the last two digits are accumulated more to the left side in the accumulating means 11. Therefore, when the sheets or the like 2 accumulated in the accumulating means 11 are moved to the supply means 1, as shown in FIG. 11, the sheets or the like 2 having 00 as the last two digits are arranged at the rightmost position, with those having 99 as the last two digits are arranged at the leftmost position, and thus the second stage processing is finished.

Figure 12:
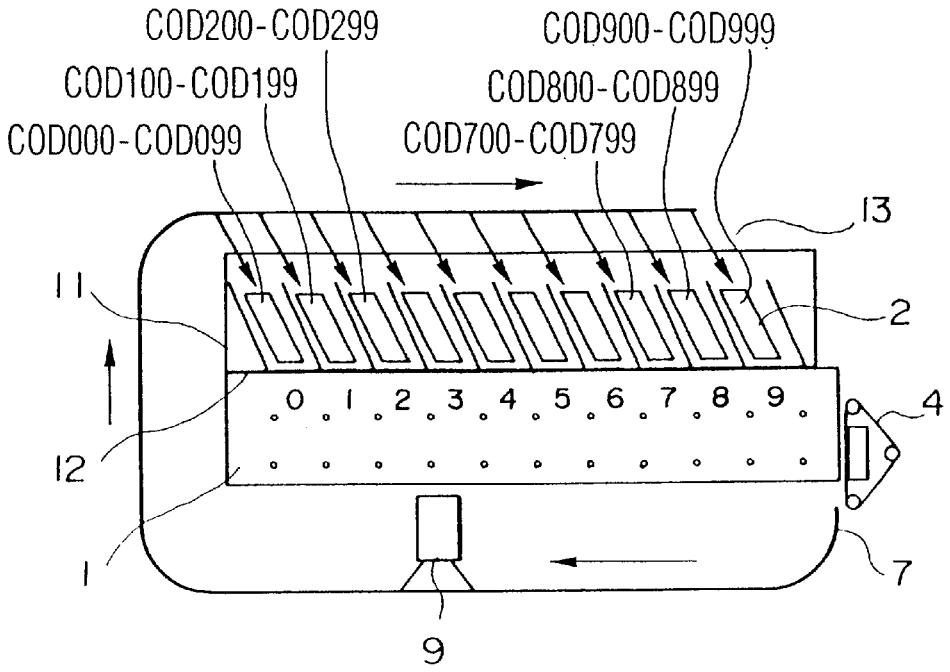
FIG. 12 is an explanatory diagram showing an additional example of the delivery route sequencing operation in the apparatus for sorting sheets or the like according to the present invention.
Figure 13:
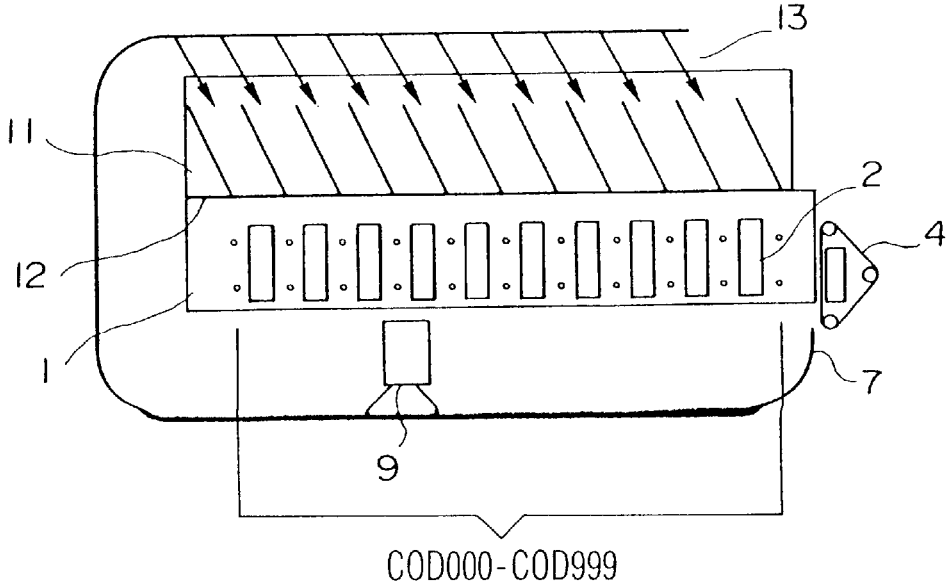
FIG. 13 is an explanatory diagram showing a further example of the delivery route sequencing operation in the apparatus for sorting sheets or the like according to the present invention.

In the third stage processing of sorting, as shown in FIG. 12, the sorting compartments S0 to S9 in the accumulating means 11 are associated with numbers 0 to 9. As shown in FIG. 11, the sheets or the like 2 having 00 as the last two digits are supplied to the separating means 4, their destination codes 15 are read by the first destination code reading means 9, and the sheets or the like are thrown into the sorting compartments which have numbers corresponding to the numbers at 100's place of their destination codes 15.

The sheets or the like 2 having any of numbers 8 to 0 at 100's place are sorted and thrown into one of the sorting compartments S0 to S9 corresponding to the numbers at 100's place of decoded destination codes 15.

Consequently, in the sorting compartment S0, the sheets or the like 2 are accumulated in such a way that the number at 100's place is 0 and the last two digits become greater from left to right. In the sorting compartment S1, the sheets or the like are accumulated in such a way that the number at 100's place is 1 and the last two digits become greater from left to right. Similarly, in the last sorting compartment S10, the sheets or the like 2 are accumulated in such a way that the number at 100's place is 9 and the last two digits become greater from left to right. Therefore, when the third stage processing is finished, the sheets or the like 2 of COD000 to COD999 are accumulated in the ascending order from left to right so that the destination codes increase from left to right.

The sequencing sorting has been described, and this algorithm itself is well known. Though description has been made of a case where the three-digit destination codes were sequenced so that their numbers are smaller from right to left. For example, in FIGS. 8, 10 and 12, if the sequencing of code numbers in relation to the sorting compartments S0 to S9 is set in a completely reverse sequence, the sheets or the like 2 can be sequenced so that the rightmost code is COD000 and the leftmost code is COD999. In the above case, the sequencing operation of the three-digit code numbers from COD000 to COD999 (1000 kinds) was done by repeating sorting to the ten sorting compartments three times, but the sequencing operation is not limited to this method, more specifically, if the number of sorting compartments is U and the number of times of repetition is n, it is possible to perform U to the n-th power ways of sequencing.

Meanwhile, in an actual sorting work, the quantity of sheets or the like to a specific destination (sorting compartment) is so large that sorting compartment becomes full in the course of sorting. A method for such a case is to accumulate in a separately-installed reject box the sheets or the like 2 to be sorted in the sorting compartment which is already full. In this method, however, after the sorting operation is finished, it is necessary to manually insert the sheets or the like 2 accumulated in the reject box into specified positions.

Description will then be made of processing in a case where any of the sorting compartments S0 to S9 is filled with sheets or the like to overflowing in the course of sorting.

Figure 14:
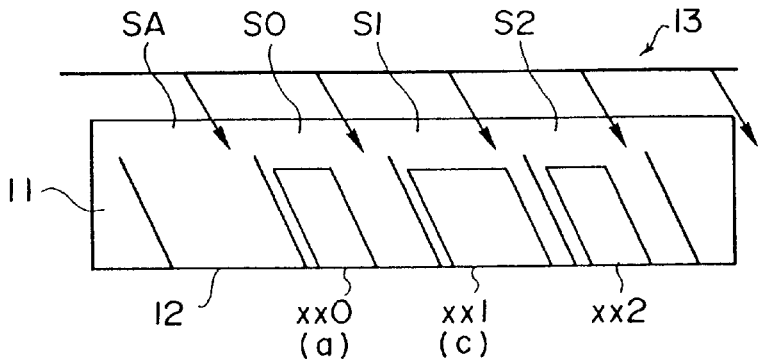
FIG. 14 is an explanatory diagram showing an example of a sorting operation for the first time in the apparatus for sorting sheets or the like according to the present invention.
Figure 15:
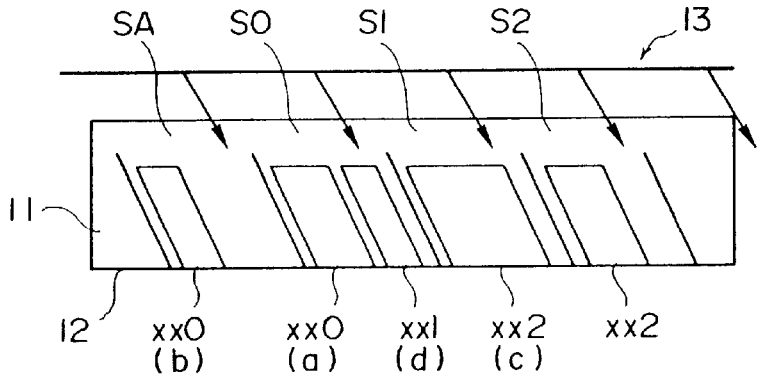
FIG. 15 is an explanatory diagram showing another example of the sorting operation for the first time in the apparatus for sorting sheets or the like according to the present invention.

FIGS. 14 and 15 schematically show the operation when overflowing occurs in the first stage sorting, that is, in the middle of sorting by the code number at unit's place, but depict only a part of the accumulating means 11. In addition to the sorting compartments, an auxiliary sorting compartment SA to be used when overflow of the sheets or the like 2 occurs is provided adjacent to the sorting compartment S0.

In FIG. 14, the sorting compartment S1 for storing only the sheets or the like 2 whose destination codes have "1" at unit's place is full of sheets or the like (c), but the sheets or the like accumulated in the sorting compartment S0 have yet to reach the capacity and the sorting compartment S2 has room to be filled. Since the sorting compartment S1 is unable to accommodate the sheets or the like any more, the sheets or the like with "1" at unit's place are hereafter thrown into the sorting compartment S0 into which the sheets or the like 2 with "0" at unit's place have so far been accumulated. At the same time, the sheets or the like 2 with "0" at unit's place are thrown into the auxiliary sorting compartment SA.

FIG. 15 shows the condition of the sheets or the like 2 accumulated by the above setting of the sorting compartments. In the sorting compartment S0, the sheets or the like 2 (d) with "1" at unit's place are stacked upon the sheets or the like 2 (a) with "0" at unit's place. In the auxiliary sorting compartment SA, the sheets or the like 2 sorted after the sheets or the like 2 (a) are accumulated. The sheets or the like 2 (a) and the sheets or the like 2 (b) are accumulated in different sorting compartments, but are consecutive in order without having sheets or the like with any other number at unit's place mixed between them. Likewise, the sheets or the like 2 (d) and the sheets or the like 2 (c) are consecutive in order though they are accumulated in different sorting compartments.

Therefore, the condition of the sheets or the like 2 in FIG. 15 is the same as the condition of the sheets or the like 2 accumulated in different sorting compartments according to the numbers at unit's place as shown in FIG. 8, and the sorting operation shown in FIG. 9 and subsequent figures can be continued.

Figure 16:
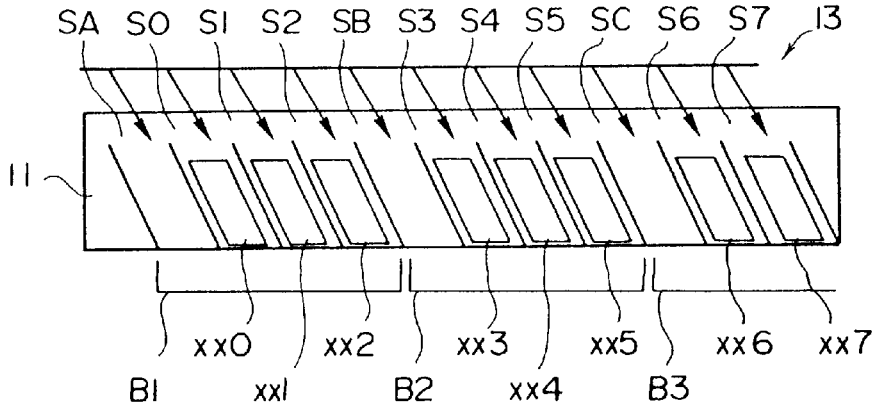
FIG. 16 is an explanatory diagram showing yet another example of the sorting operation for the first time in the apparatus for sorting sheets or the like according to the present invention.

If there is only one sorting compartment of SA, it is possible to cope with only one case where an overflow occurs at any one of the sorting compartments S0 to S9. So, FIG. 16 shows an example of coping with an overflow in a plurality of sorting compartments. In FIG. 16, like in FIG. 14, an auxiliary sorting compartment SA is provided adjacent to the sorting compartment S0, and another auxiliary sorting compartment SB is provided between the sorting compartments S2 and S3, and yet another auxiliary sorting compartment SC is provided between the sorting compartments S5 and S6. If the sorting compartments SA to S2 are designated as a first block B1 and the sorting compartments SB to S5 are designated as a second B2 block and the sorting compartments SC and beyond are designated as a third block B3, in the first block B1, when an overflow of sheets or the like 2 occurs in any one of the sorting compartments S0 to S2, the overflow can be prevented by performing the same operation as was described with reference to FIGS. 14 and 15. Likewise, in the second block B2 or the third block B3, too, it is possible to prevent an overflow of sheets or the like 2 which may occur in any of the sorting compartments S3 to S5 or in any of the sorting compartments S6 to S9. As mentioned above, by dividing the all sorting compartments of the accumulating means 11 into a plurality of blocks and providing an auxiliary sorting compartment in each block, even if an overflow occurs in one of the sorting compartments in each block, the sheets or the like 2 are not rejected and the sorting process can be continued.

In the first block B1, the second block B2 and the third block B3, an auxiliary sorting compartment is provided for every three to four sorting compartments, but this embodiment is not restrictive, and therefore if the sorting compartments where an overflow is liable to occur or least liable to occur are known, an auxiliary sorting compartment may be provided for two or five sorting compartments, for example. If this method is applied to mail sorting, this method will be effective when some specific destinations to which lots of mail are sent can be presumed from the past records.

In the above-described procedure, when an overflow occurs, the sheets or the like 2 are accumulated in an adjacent sorting compartment, so that the order in which the sheets or the like are arranged changes. On the other hand, the above-mentioned method is not used in the second or third stay processings because the sheets or the like must be accumulated in order.

To prevent an overflow of sheets or the like 2 in the second stage or the third stage processing, an effective method is to predict a sorting compartment where an overflow is liable to occur from the destination codes 15 of all sheets or the like 2 read in the sorting by the code numbers at unit's place, and allocate a plurality of sorting compartments. The operation of an embodiment of this method will be described with reference to the flowcharts.

Figure 17:
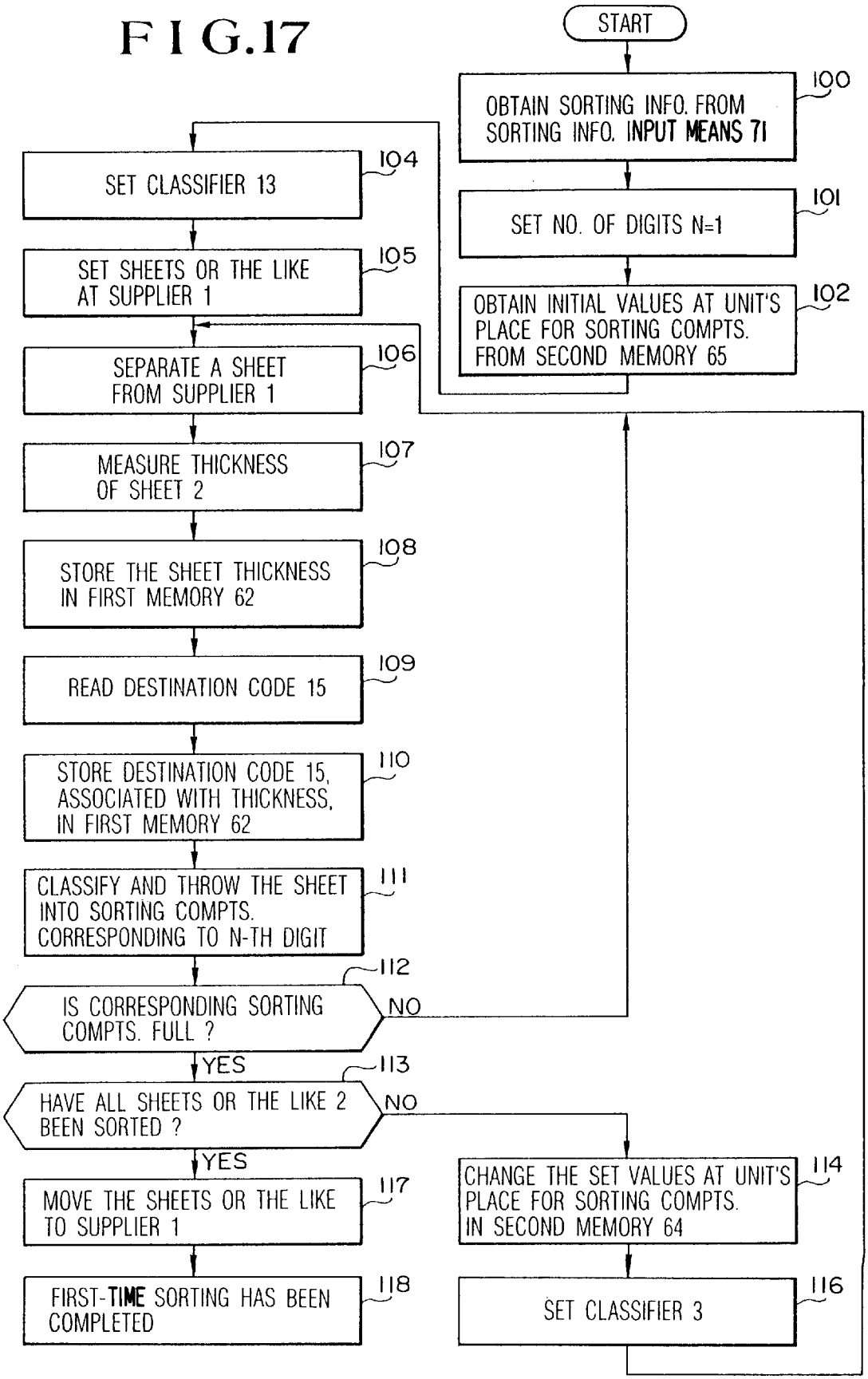
FIG. 17 is a flowchart showing an example of the sorting operation in the apparatus for sorting sheets or the like according to the present invention.
Figure 18:
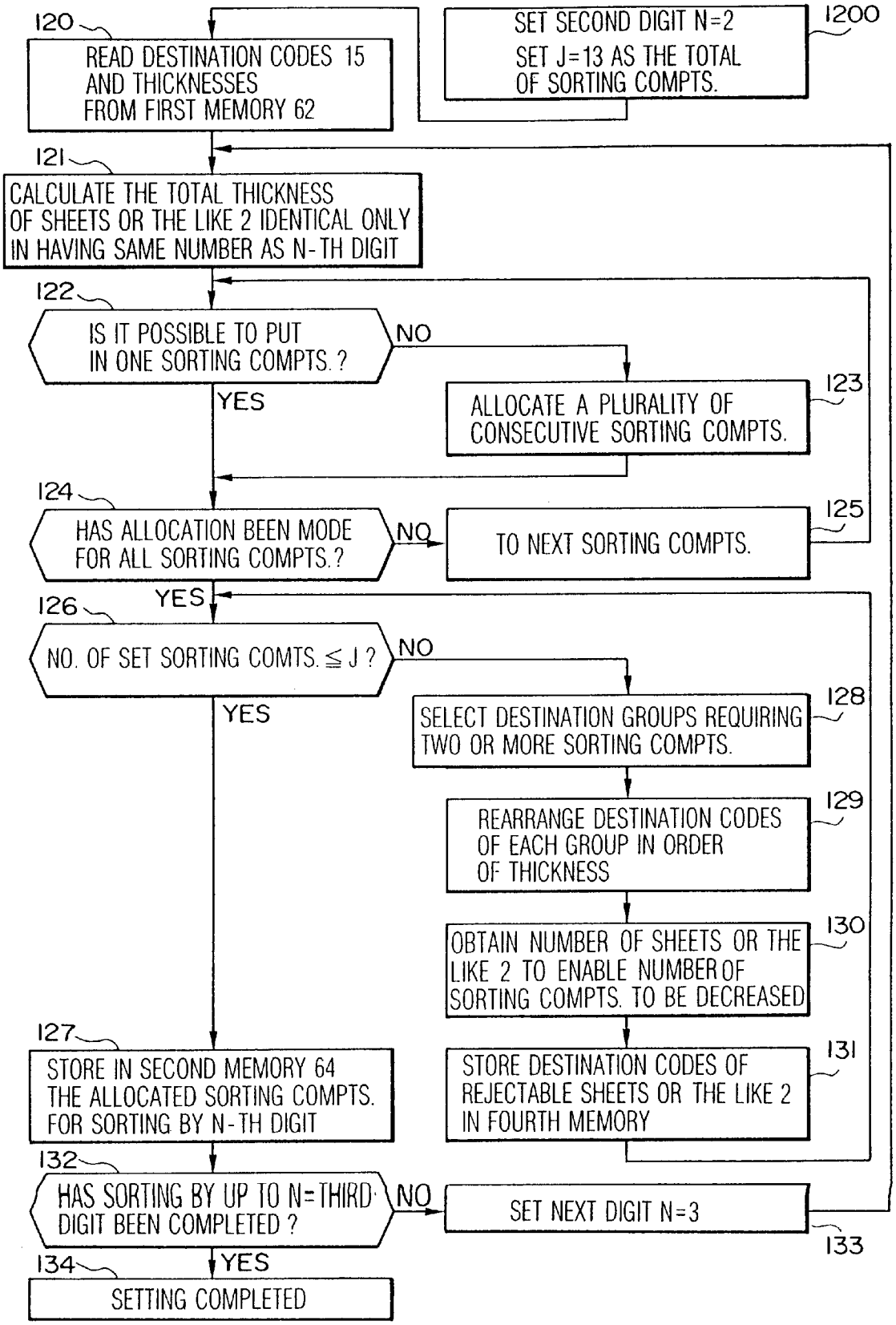
FIG. 18 is a flowchart showing an example of the sorting operation in the apparatus for sorting sheets or the like according to the present invention.
Figure 19:
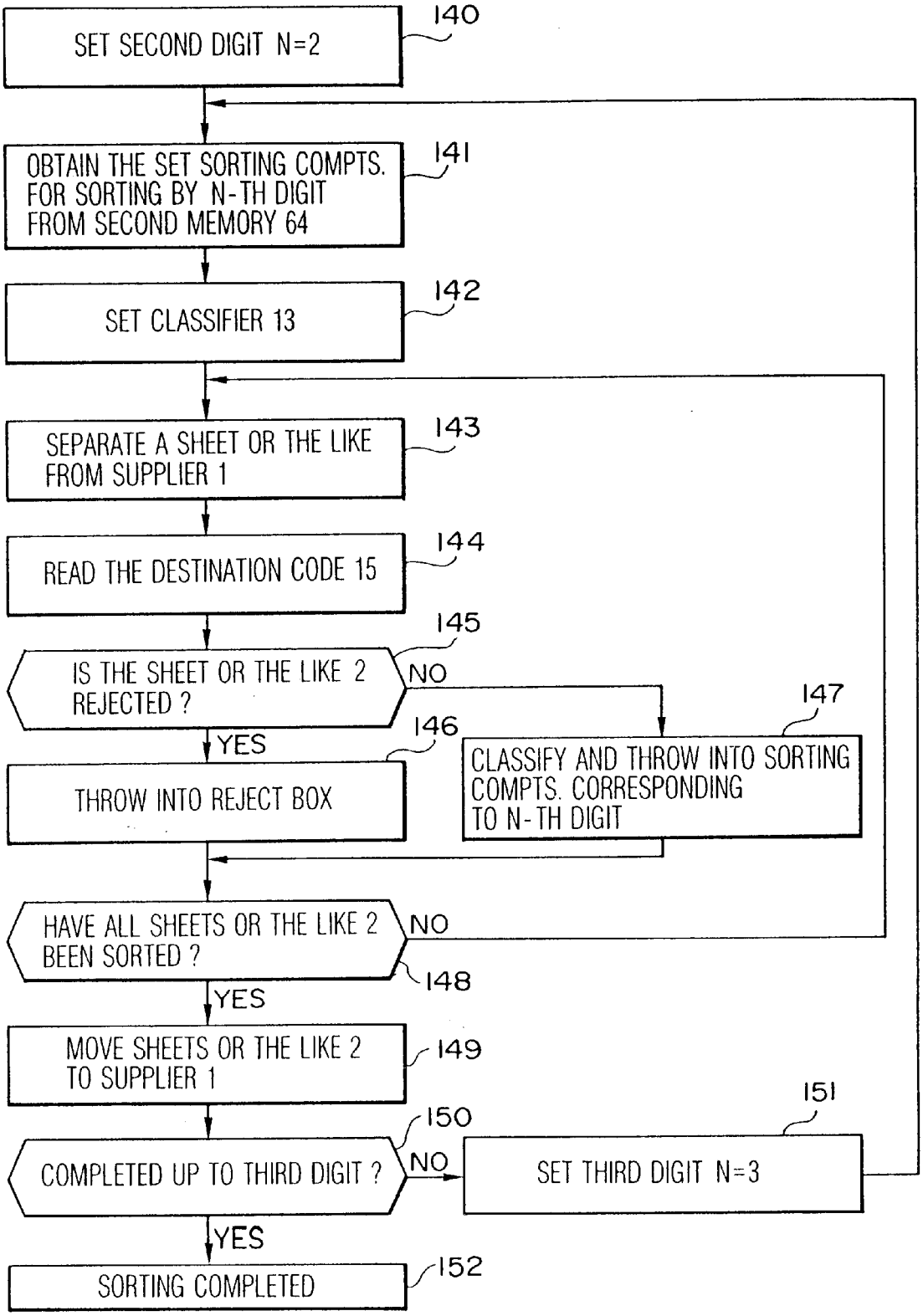
FIG. 19 is a flowchart showing yet another example of the sorting operation in the apparatus for sorting sheets or the like according to the present invention.

FIGS. 17 to 19 are flowcharts showing the operation of the apparatus for sorting sheets or the like according to the present invention. FIG. 17 shows the operation of the first stage processing, and FIGS. 18 and 19 show the second stage and the third stage processing.

The operation of the first stage processing will be described with reference to FIG. 17. First, delivery sorting information is obtained which shows the correspondence between the destination codes 15 given to the sheets or the like 2 to be processed and the delivery route from the sorting information input means 71 (step 100). At the same time, the sorting compartments which the sheets or the like 2 to be processed go into are inputted. The first stage sorting operation starts with the code numbers at unit's place, so N=1 is set as the first digit (step 101). Then, from the second memory unit 64, initial setting values for the code numbers at unit's place and the corresponding sorting compartments are obtained for sorting by the numbers at unit's place (step 102), and the classifier means 13 is set (step 104). An example of this initial setting is shown in Item 202 of Table 1. In this example, like in the description done with reference to FIG. 16, auxiliary sorting compartments SA, SB and SC are provided. It may sometimes occur that adequate positions in which to provide the auxiliary sorting compartments differ with the destinations of the sheets or the like 2. For example, if it is predicted from the past records that overflow is likely to occur often in the sorting compartments S3 and S4, an auxiliary sorting compartment SB may be provided between the sorting compartments S4 and S5.

TABLE 1

| Example of Second Memory | | | | | | | | | | | | | |
|---|---|---|---|---|---|---|---|---|---|---|---|---|---|
| Sorting compt. | SA | S0 | S1 | S2 | SB | S3 | S4 | S5 | SC | S6 | S7 | S8 | S9 |
| Initial setting | — | xx0 | xx1 | xx2 | — | xx3 | xx4 | xx5 | — | xx6 | xx7 | xx8 | xx9 |
| After overflows | xx0 | xx1 | — | xx2 | — | xx3 | xx4 | xx5 | xx6 | xx7 | xx8 | — | xx9 |

Then, sheets or the like are set in the supply portion (step 105), the separating means 4 is driven to separate a sheet from the sheets or the like 2 and delivered to the transfer system 7 (step 106), and the thickness of the sheet or the like 2 is measured by the thickness measuring means 18 (step 107). The measured thickness of the sheet or the like 2 are stored in the first memory unit 62 (step 108). Next, the destination code 15 is read by the destination code reading means 9 (step 109), and the destination code is associated with the thickness and stored in the first memory unit 62 (step 110). The contents of the first memory unit 62 at this time are shown as an example in Table 2. The sheet serial number (Item 204) is the number given sequentially to each sheet. Thus, the first memory unit 62 stores the destination code (Item 205) associated with the thickness (Item 206) for each sheet or the like 2.

TABLE 2

| Contents of First Memory | | |
|---|---|---|
| Sheet Ser No. | Destination Code | Thickness |
| 000 | COD981 | 2 |
| 001 | COD454 | 1 |
| 002 | COD214 | 1 |
| 003 | COD648 | 3 |
| 004 | COD020 | 1 |
| . | . | . |
| . | . | . |
| . | . | . |
| 998 | COD234 | 1 |
| 999 | COD522 | 5 |
| 204 | 205 | 206 |

The classifier means 13 corresponding to the number at unit's place of the destination code is operated to classify the sheet into the relevant sorting compartment (step 111). If that sorting compartment is full, the sheet cannot be accommodated, and abnormality detecting means issues an abnormality signal (step 112). If the sorting compartment is not full, the sorting operation continues by repeating steps 106 to 111. However, when the relevant sorting compartment is full and there remain sheets or the like 2 to be sorted (step 113), the set values at unit's place for the sorting compartments are changed in the second memory unit (step 114). For example, if an overflow occurs in the sorting compartment S1 for which number "1" is set at unit's place, as shown in the columns SA, S0 and S1 in Item 203, the initial setting for the sorting compartment S1 is reset and the existing settings for S0 and S1 are moved each one step in the direction of the auxiliary sorting compartment SA. The settings of the classifier means 13 are similarly changed (step 116), and steps from 106 to 111 are repeated. Item 203 of Table 1 shows a case where the sorting compartments S1 and S8 are full.

When all sheets or the like 2 have been sorted, all sheets or the like 2 in the accumulating means 11 are moved to the supply means without changing the current order. With this, the first stage sorting by the numbers at unit's place of the destination codes is finished.

Then, the second stage sorting, in other words, sorting by the numbers at 10's place (second digit) of the destination codes is performed. Initially, by the procedure in FIG. 18, the sorting compartments are set by using the destination codes and the thicknesses of all sheets or the like, obtained by the first stage sorting.

In FIG. 18, N=2 is set as the second digit, and the total number of the sorting compartments, more specifically, the total number of the sorting compartments provided in the apparatus for sorting sheets or the like according to this embodiment is set at 13 (step 1200). The destination codes and the thicknesses of all sheets or the like 2 are read from the first memory unit 62 (step 120), the thicknesses of the sheets or the like 2 having destination codes including the same number at 10's place (second digit) are totaled (step 121), and a decision is made whether or not those sheets or the like can be accommodated in one sorting compartment (step 122). If it is predicted that sheets or the like overflow from the sorting compartment, a plurality of consecutive sorting compartments are allocated for the sheets with the same number (step 123). An example of setting the sorting compartments will be describe with reference to Table 3.

TABLE 3

Example of Setting Sorting Compartments in Sorting by Second Digit

| | Group 0 | | Group 1 | | | Group 9 | |
|---|---|---|---|---|---|---|---|
| | Destination code | Thick-ness | Destination code | Thick-ness | . . . . . | Destination code | Thick-ness |
| Data read | COD104 | 5 | COD211 | 2 | . . . | COD093 | 1 |
| | COD200 | 1 | COD816 | 2 | . . . | COD592 | 1 |
| | C0D806 | 1 | COD017 | 1 | . . . | COD099 | 4 |
| | C0D407 | 2 | COD414 | 1 | . . . | COD291 | 2 |
| | . | . | . | . | . . . . | . | . |
| | . | . | . | . | . . . . | . | . |
| | . | . | . | . | . . . . | . | . |
| | COD007 | 3 | COD913 | 3 | . . . | COD194 | 1 |
| | | | COD119 | 4 | . . . | | |
| Total thickness | ΣCODx0x | 60 (<S) | ΣCODx1x | 85 (>S) | . . . | ΣCODx9x | 55 (<S) |
| No. of sorting compt. | | 1 | | 2 | . . . | | 1 |

In Table 3, groups 0, 1 and 9 are the groups of the destination codes and the thicknesses having respectively the same numbers at 10's place of the destination codes. The group 0 includes the sheets or the like having 0 at 10's place, and the group 1 includes the sheets or the like having 1 at 10's place. The thicknesses of the sheets or the like of each group are totaled. For example, x is used to designate an arbitrary number and the total thickness of the sheets or the like having 0 at 10's place of the destination codes is designated by ΣCODx0x, and the thickness of the sheets or the like 2 that can be accommodated in one sorting compartment is designated by S. As an example, suppose S=70 mm. In group 0, if ΣCODx0x is 60 mm, since ΣCODx0x<S, it is understood that all sheets or the like with 0 at 10's place (second digit) can be accommodated. However, in group 1, if ΣCODx0x is 85 mm, since ΣCODx1x>S, those sheets or the like 2 cannot be accommodated in one sorting compartment.

The above-mentioned operation is repeated until the number at 10's digit is 9 and, for example, two or more consecutive sorting compartments are allocated for the sheets or the like 2 having 1 at 10's digit of the destination codes. A decision is made whether or not allocations have been made for all sorting compartments (step 124), and if not, similar setting is made for the next sorting compartment (step 125).

Then, a decision is made whether or not the number of sorting compartments which have been set is greater than or equal to the total number of sorting compartments J (step 126). If the decision is YES, all sheets or the like 2 can be accumulated. Therefore, the allocated sorting compartments are stored in the second memory unit 64 and setting of N=the second digit is completed (step 127). On the other hand, if the number of allocated sorting compartments is larger than the total number of sorting compartments J, the sorting compartments are insufficient for accommodating all sheets or the like 2. In this case, groups of sheets or the like are selected which require a plurality of sorting compartments to be allocated (step 128), and the allocated sorting compartments are set anew by rejecting some sheets or the like 2 to reduce the required number of sorting compartments. An example in this case will be described with reference to Tables 4 and 5.

TABLE 4

Example of Setting Sorting Spaces

| | Total thickness | | Thickness distribution to sorting compartments (mm) | | | No. of |
|---|---|---|---|---|---|---|
| Group | Destination code | Thickness (mm) | No. 1 | No. 2 | No. 3 | sorting spaces |
| 0 | ΣCODx0x | 60 | 60 | | | 1 |
| 1 | ΣCODx1X | 85 | 70 | 15 | | 2 |
| 2 | ΣCODx2x | 45 | 45 | | | 1 |
| 3 | ΣCODx3x | 150 | 70 | 70 | 10 | 3 |
| 4 | ΣCODx4x | 20 | 20 | | | 1 |
| 5 | ΣCODx5x | 120 | 70 | 50 | | 2 |
| 6 | ΣCODx6x | 15 | 15 | | | 1 |
| 7 | ΣCODx7x | 100 | 70 | 30 | | 2 |
| 8 | ΣCODx8x | 40 | 40 | | | 1 |
| 9 | ΣCODx9x | 55 | 55 | | | 1 |
| | | | Total of required sorting compartment: 15 | | | |

Table 4 shows an example of the total thickness of sheets or the like 2 to be accumulated in groups 0 to 9 shown in Table 3 and allocated accumulation thicknesses of the respective sorting compartments. So long as the total thickness of each group is 70 mm or less, sheets or the like can be accumulated in one sorting compartment. However, for group 1, for example, the total thickness of which is greater than 70 mm, the excess amount over the 70 mm needs to be accumulated in the second sorting compartment, and for group 3 whose total thickness is greater than 140 mm, the excess amount needs to be accumulated using the third sorting compartment. By step 128, groups 1, 3, 5 and 7 are selected. In the example shown in Table 4, to sort all the sheets or the like 2, 15 sorting compartments are required, but because the total number of sorting compartments is 13, there are a shortage of two sorting compartments to allocate. In this case, the sheets or the like 2, which cannot be accommodated in the 13 sorting compartments and which have two imaginary sorting compartments allocated, have to be rejected and manually added to the already sorted sheets or the like 2. The quantity of sheets or the like to be rejected should be minimized, so that it is better to sequentially select those sorting compartments which have smaller numbers of sheets or the like to be rejected. For example, in the example shown in Table 4, if the number of allocated sorting compartments for groups 1 and 3 is reduced from 2 to 1 and from 3 to 2, respectively, it is only necessary to reject sheets with a thickness of no more than 25 mm. Furthermore, if the sheets with greater thickness are selectively rejected sooner than others, the number of sheets or the like to be rejected can be made smaller. For example, for postcards each 0.3 mm in thickness, the required number of postcards is more than 80 to reach a thickness of 25 mm, while for envelopes each 5 mm in thickness, the required number of envelopes is five at most to reach the 25 mm thickness. So, mails are sequenced in the descending order of thickness for each destination group by the order forming means and stored in the third memory unit 65 (step 129). Table 5 shows an example of contents of the third memory unit.

TABLE 5

Example of Setting Sorting Compartments in Sorting by Second Digit (Contents of Third Memory)

| | Group 1 | | Group 3 | | Group 7 | |
|---|---|---|---|---|---|---|
| | Destination code | Thickness | Destination code | Thickness | Destination code | Thickness |
| Data Read | COD114 | 5 | COD231 | 6 | COD073 | 6 |
| | COD017 | 5 | COD836 | 6 | COD572 | 5 |
| | COD417 | 4 | COD037 | 5 | COD079 | 5 |
| | COD933 | 4 | COD434 | 5 | COD271 | 5 |
| | . | . | . | . | . | . |
| | . | . | . | . | . | . |
| | . | . | . | . | . | . |
| | COD210 | 1 | COD933 | 1 | COD174 | 1 |
| | COD816 | 1 | COD139 | 1 | | |
| Total Thickness | ΣCODx1x | 85 | ΣCODx3x | 150 | ΣCODx7x | 100 |
| No. of Sorting Compts. | | 2 | | 3 | | 2 |

Table 5 shows examples of groups 1, 3 and 7. It is understood from Table 5 that in group 1, since it is only necessary to reject sheets or the like corresponding to a thickness of no more than 15 mm, four thickest sheets or the like need to be rejected and in group 3, two thickest sheets or the like need to be rejected. In this way, it is possible to find in each group the number of sheets or the like 2 that allows the number of sorting compartments to be decreased (step 130). With regard to the sheets or the like 2 to be rejected obtained by the above method, their destination codes are stored in the fourth memory unit 66 (step 131) and, when they are read, they are rejected without being sorted. An example of the contents of the fourth memory unit 66 is shown in Table 6, more specifically, the destination codes of the sheets or the like 2 to be rejected are stored.

TABLE 6

Example of Contents of Fourth Memory

| Destination code |
|---|
| COD114 |
| COD017 |

TABLE 6-continued

Example of Contents of Fourth Memory

| Destination code |
|---|
| COD417 |
| COD933 |
| COD231 |
| COD836 |

If sheets or the like 2 are rejected in advance in the descending order of thickness as has been discussed above, the number of sheets or the like 2 rejected when the number of sorting compartments is smaller than or equal to the total number of sorting compartments J can be minimized, so that subsequent manual insertion work can be decreased.

If the destination codes of the sheets or the like 2 which are to be rejected are decided, the required number of sorting compartments becomes smaller than or equal to J, so that the allocated sorting compartments are stored in the second memory unit 64 (step 127). This operation is repeated up to the third digit of the destination codes (steps 132 and 133), and settings are finished with setting of the sorting compartments in the third stage of sorting (step 134). In the third stage of sorting, the sheets or the like 2 of the destination codes stored in the fourth memory unit 66 have already been rejected, so that allocation of the sorting compartments has only to be done for the remaining sheets or the like 2 exclusive of those rejected.

The allocated sorting compartments in the second stage and the third stage sorting obtained as described and stored in the second memory unit 64 are shown as an example in Table 7. The example in sorting by the second digit (second stage sorting) in Table 7 corresponds to the examples shown in Tables 4 to 6. One sorting compartment is allocated to group 1 (x1x), two sorting compartments are allocated to group (x3x), with sheets or the like 2 of the destination codes shown in Table 6 being rejected.

TABLE 7

| | Example of Contents of Second Memory | | | | | | | | | | | | |
|---|---|---|---|---|---|---|---|---|---|---|---|---|---|
| Sorting compt. | SA | S0 | S1 | S2 | SB | S3 | S4 | S5 | SC | S6 | S7 | S8 | S9 |
| Sorting by second digit | x9x | x8x | x7x | x7x | x6x | x5x | x5x | x4x | x3x | x3x | x2x | x1x | x0x |
| Sorting by third digit | 0xx | 1xx | 1xx | 2xx | 3xx | 4xx | 5xx | 6xx | 7xx | 7xx | 8xx | 8xx | 9xx |

After the sorting compartments in sorting by the second digit and sorting by the third digit have been set, the sorting operation in the second stage is started. In FIG. 19, numbers are set at the second digit of the destination codes (step 140), the allocated sorting compartments in the second stage are obtained from the second memory unit 64 (step 141), in accordance with which the classifier means 13 is set (step 142). A sheet or the like 2 is separated (step 143), and its destination code is read (step 144). The destination code is compared with the destination codes stored in the fourth memory unit 66 (step 145), and if the destination code coincides with a destination code stored in the fourth memory unit 66, this means that that sheet or the like is one to be rejected, and therefore the sheet is thrown into the reject box (step 146). If they don't coincide, the sheet is classified and thrown into the corresponding sorting compartment (step 147), a decision is made whether or not sorting has been completed (step 148), and if sorting has not been completed, steps 143 to 148 are repeated. When all sheets or the like 2 have been sorted, all the sheets or the like are moved from the accumulating means 11 to the supply means keeping their order unchanged (step 149). A decision is made whether or not sorting up to the third stage (third digit) has been finished (step 150), and if not finished, 3 is set as the digit for sorting of the third stage (step 151), the numbers to be set as the third digit for the sorting compartments as shown in FIG. 7 are obtained from the second memory unit 64 (step 141), and steps 142 to 149 are repeated. When sorting of the third stage (third digit) is completed, sorting of all sheets or the like 2 is finished (step 152).

In this embodiment, the thickness of all sheets or the like 2 to be processed is supposed to be measured. However, when the sheets or the like 2 to be processed are postcards only, for example, and their thickness is known, thickness measurement can be omitted and preset information about thickness may be used.

Further, even if sheets or the like 2 of different thicknesses are mixed, for example, an average thickness may be used and the thickness measuring means 18 omitted. In this case, the first memory unit is used to store destination codes only. When setting the sorting compartments as shown in Table 3, since in this case all sheets or the like are supposed to have an equal thickness, an average thickness may be used. In Table 5 and in steps 129 to 131 in FIG. 18, since all sheets or the like are supposed to have an equal thickness, it is impossible to previously decide the destination codes of the sheets or the like to reject. Therefore, in such a case as above, in reducing the allocated sorting compartments in Table 4, those compartments for smaller thicknesses should be reduced by being given preference over others, and when the allocated sorting compartments become full, the subsequently sorted sheets or the like 2 should be rejected.

Meanwhile, the length differs between postcards and a majority of envelopes, or rather the envelopes are longer. Therefore, by measuring the length of the sheets or the like 2 midway through the transfer path 7, whether an individual sheet or the like 2 being processed is a postcard or an envelope can be determined almost completely. Because envelopes are thicker than postcards, if several kinds of thickness are used which correspond to measured lengths, overflow can be predicted with higher precision than by using an average thickness indiscriminately. In measuring the length as mentioned above, if the time of the light of an optical sensor being intercepted by a sheet or the like is measured by the optical sensor, the length of sheets or the like can be measured from the transfer speed of the sheets or the like by the transfer path 7 and the light interception time. If a sheet or the like is determined as a post card and the thickness is set at 0.3 mm, or if a sheet or the like is determined as an envelope and the thickness is set at 2 mm for example, by using those two kinds of thickness, the same process can be performed as when the thickness is measured by the measuring means 18 in this embodiment.

According to the embodiment of the present invention, by using a small sorter with about 13 to 15 sorting compartments, it is possible to sequence the sheets or the like with destination codes indicated, or mails for example in an order designated by the destination codes. As an example, if the destination codes indicate the delivery points and their list is associated with the delivery route, the supplied mails can be sequenced along the route traveled in delivering mail.

Further, when auxiliary sorting compartments are set and the regular sorting compartments become full, the allocation of the sorting compartments can be changed, and therefore if the sheets or the like are concentrated in some sorting compartments, there are less chances that the sorting compartments becomes full and are unable to accommodate any more, so that the sheets or the like can be sequenced effectively.

Further, by using the destination codes and the thicknesses read in the sorting operation for the first time, if overflow is predicted and it is also predicted that the sheets or the like cannot be accommodated, overflow can be prevented by allocating two or more consecutive sorting compartments.

Further, if sheets or the like are rejected when the number of the allocated sorting compartments exceeds the total number of the sorting compartments provided in the apparatus for sorting sheets or the like, by having the sheets or the like to be rejected in the order of thickness determined previously, the number of sheets or the like to be rejected can be decreased, and the number of sheets or the like to be inserted manually after sorting is over can be reduced, so that the efficiency of the sorting work can be improved.

According to the present invention, the sorting apparatus is so structured that the accumulator is located above the feed means, and when the sheets or the like sorted and accumulated in the accumulator are supplied again to the supply means, the sheets or the like can be moved from the accumulator to the feed means. Therefore, the delivery route sequencing work can be done with higher efficiency and the apparatus can be reduced in size.

According to the present invention, auxiliary sorting shelves are dispersed among the regular sorting shelves and the shelves are divided into blocks, and if an overflow occurs, the correspondence between the destinations and the sorting shelves is shifted (if an overflow occurs at the fifth compartment, for example, in the sorting operation for the first time, the second shelf compartment is shifted to the first (more specifically, to the preceding auxiliary shelf compartment), the third compartment to the second, the fourth compartment to the third, the fifth compartment that is to overflow to the fourth. The sorting compartments are set for the sorting operation for the second time by the destinations obtained in the sorting for the first time, so that batch movement is thus made possible, and no problem arises because the general (procedure) of delivery route sequencing remains unchanged.

Note that the delivery route sequencing in the present invention is done by the radix sorting method.

Information about the thickness of mails is obtained in the sorting operation for the first time, thereby reducing waste time. This is possible because countermeasures for overflow are taken even in the sorting operation for the first time as mentioned above. Thicker mails are rejected by preference over others, thereby reducing the quantity to be rejected. Further, in the present invention, various contrivances are made, including the return to the same sorting shelf/hopper, and the prediction of the thickness by measurement of postal matter.

Therefore, according to the present invention, the sheets or the like, such as postal matter, on which the destination codes are indicated, can be rearranged sequentially by the destination codes, so that the efficiency of the delivery route sequencing can be improved.

What is claimed is:

1. A method for sorting sheets, comprising the steps of:

performing an initial sorting operation which includes the following sorting steps:

separating a sheet from a plurality of sheets fed from feed means holding said sheets in upright position;

reading a first destination code of a plurality of first destination codes from said sheet;

storing said first destination code in a first memory unit;

storing, in a second memory unit, a first sorting setting showing a correspondence between said plurality of first destination codes and a plurality of sorting compartments in an accumulating means;

classifying said sheet by referencing the first sorting setting in said second memory to identify one of said plurality of sorting compartments corresponding to said first destination code stored in said first memory unit;

throwing said sheet into said one of said plurality of sorting compartments of said accumulating means;

performing a series of said sorting steps to sequentially sort and accumulate remaining ones of said plurality of sheets into said plurality of sorting compartments of said accumulating means, located above and adjacent to said feed means, according to said first sorting setting, said plurality of sorting compartments now holding a plurality sorted and accumulated sheets;

moving the plurality of sorted and accumulated sheets from said accumulating means to said feed means; and subsequently, rearranging said plurality of sorted and accumulated sheets in a specified order by performing another sorting operation, which includes the following sorting steps:

determining a second sorting setting showing a correspondence between second destination codes and said plurality of sorting compartments;

storing said second sorting setting in said second memory unit; and reading second destination codes from said plurality of sorted and accumulated sheets;

classifying said plurality of sorted and accumulated sheets by referencing the second sorting setting in said second memory to identify sorting compartments in said plurality of sorting compartments corresponding to respective ones of the second destination codes read from said plurality of sorted and accumulated sheets; and throwing said plurality of sorted and accumulated sheets into the sorting compartments identified in said classifying step.

2. A method for sorting sheets according to claim 1, further comprising the steps of:

providing, in an apparatus of sorting sheets, an auxiliary sorting compartment adjacent to at least one of said sorting compartments and abnormality detecting means for detecting an abnormality signal when any sorting compartment becomes unable to accumulate said sheets;

stopping sorting and throwing said sheets into allocated sorting compartments when said abnormality signal is detected during said initial sorting operation;

changing said sorting setting, which has been allocated to all the sorting compartments from a sorting compartment closest to said auxiliary sorting compartment to a sorting compartment where said abnormality signal was detected, and then allocating the changed sorting setting to all the sorting compartments from said auxiliary sorting compartment to a sorting compartment adjacent on said auxiliary sorting compartment to said sorting compartment where said abnormality signal was detected, and storing said changed sorting setting in said second memory unit; and continuing said initial sorting operation according to said sorting setting stored in said second memory unit.

3. A method for sorting sheets according to claim 2, wherein said first sorting setting sets a plurality of said auxiliary sorting compartments and also provides a plurality of sorting compartments between said auxiliary sorting compartments.

4. A method for sorting sheets according to claim 2, further comprising the steps of:

selecting one of a plurality of groups of destination codes, and providing sorting information inputting means for inputting a specified sequencing order previously determined for each of said plurality of groups of destination codes and also inputting said first sorting setting, wherein a way in which said auxiliary sorting compartments and said sorting compartments are arranged in said first sorting setting differs with different groups of destination codes.

5. A method for sorting sheets according to claim 1, wherein said sheets accumulated in said accumulating means are moved to said feed means by keeping their order unchanged, and a sheet is separated again from a stack of sheets by said separating means.

6. A method according to claim 1, wherein said initial sorting operation and said another sorting operation are both performed automatically.

7. A method according to claim 1, wherein said step of moving the plurality of sorted and accumulated sheets from said accumulating means to said feed means is performed automatically.

8. An apparatus for sorting sheets comprising:

feed means for holding a plurality of sheets in upright position;

separating means for separating a sheet from inside said feed means;

accumulating means, located adjacent to and above said feed means and having a plurality of sorting compartments, for sequentially accumulating sheets in upright position;

destination code reading means for reading destination codes previously attached to said plurality of sheets;

means for connecting said separating means and said accumulating means, for transferring sheets;

a first memory unit for storing said destination codes of the sheets read by said destination code reading means;

a second memory unit for storing a sorting setting showing a correspondence between said destination codes and said plurality of sorting compartments; and means for classifying and throwing the plurality of sheets into respective ones of the sorting compartments of said accumulating means according to said destination codes, wherein, during an initial sorting operation, said sheets supplied to said feed means are separated by said separating means one-by-one, a single sheet is transferred by said transfer means, a first destination code is read by said destination code reading means, a series of sorting steps are performed according to an initial sorting setting stored in said second memory unit to sort and accumulate said sheets in said accumulating means, and after said initial sorting operation, said sheets accumulated in said accumulating means are moved again to said feed means and then said sorting operations are repeated so that said sheets are sequenced in a specified order according to first destination codes, and wherein, during at least one of said repeated sorting operations, said second memory unit stores another sorting setting showing correspondence between second destination codes and said sorting compartments, said another sorting setting being determined by said second memory using said second destination codes, stored in said first memory unit, and said at one of said repeated sorting operations being performed according to said another sorting setting stored in said second memory unit.

9. An apparatus for sorting sheets according to claim 8, further comprising:

auxiliary sorting compartments adjacent to said sorting compartments and abnormality detecting means for detecting an abnormality signal when any sorting compartment becomes unable to accumulate said sheets, wherein when said abnormality signal is detected during said initial sorting operation, the sorting and throwing of said sheets into corresponding sorting compartments is stopped, said initial sorting setting is changed which has been allocated to all the sorting compartments from a setting compartment closest to said auxiliary sorting compartment to a sorting compartment where said abnormality signal was detected, and then allocating the changed sorting setting to all the sorting compartments from said auxiliary sorting compartment to a sorting compartment adjacent on said auxiliary sorting compartment to said sorting compartment where said abnormality signal was detected, and storing said changed sorting setting in said second memory unit, and said sorting operation is continued according to said sorting setting stored in said second memory unit.

10. An apparatus for sorting sheets according to claim 9, wherein said initial sorting setting provides a plurality of auxiliary sorting compartments in said initial sorting operation and a plurality of said sorting compartments between said auxiliary sorting compartments.

11. An apparatus for sorting sheets according to claim 9, wherein one of a plurality of groups of destination codes is selected, and sorting information inputting means for inputting a specified order of rearrangement previously determined for each group of destination codes and also inputting said initial sorting setting, wherein a way in which said auxiliary sorting compartments and said sorting compartments are arranged in said initial sorting setting differs with said different groups of destination codes.

12. An apparatus according to claim 8, wherein, after said initial sorting operation, said sheets accumulated in said accumulating means are automatically moved to said feed means.

13. A method for sorting sheets comprising the steps of:

performing a first sorting operation which includes a first set of sorting steps as follows:

separating a sheet from a plurality of sheets within a feed means;

transferring said sheet to a destination code reading means;

reading a first destination code from said sheet using said destination code reading means;

storing said destination code in a first memory unit;

storing a first sorting setting in a second memory unit, said first sorting setting defining a correspondence between a plurality of first destination codes, and a plurality of sorting compartments in an accumulating means;

classifying and throwing said sheet into one of said sorting compartments based on a correspondence that exists, as defined by said first sorting setting, between said one of said sorting compartments and the first destination code stored in said first memory unit; and performing said first set of sorting steps for remaining ones of said sheets in said feed means to sequentially sort and accumulate said remaining ones of said sheets into said plurality of sorting compartments in said accumulating means according to said first sorting setting;

automatically moving the sorted and accumulated sheets from said plurality of compartments in said accumulating means to said feed means; and performing at least a second sorting operation which includes a second set of sorting steps as follows:

separating a sheet from the sorted and accumulated sheets stored within said feed means;

transferring said separated sheet to said destination code reading means;

reading a second destination code from said separated sheet using said destination code reading means;

storing said second destination code in said first memory unit;

storing a second sorting setting in said second memory unit, said second sorting setting defining a correspondence between a plurality of second destination codes, of which the second destination code is one, and said plurality of sorting compartments in said accumulating means;

classifying and throwing said separated sheet into one of said sorting compartments based on a correspondence that exists, as defined by said second sorting setting, between said one of said sorting compartments and the second destination code stored in said first memory unit;

performing said second set of sorting steps for remaining ones of said sorted and accumulated sheets in said feed means to sequentially sort and accumulate said remaining ones of said sorted and accumulated sheets into said plurality of sorting compartments according to said second sorting setting.

14. A method according to claim 13, wherein said first plurality of destination codes equals said second plurality of destination codes.

15. A method according to claim 13, wherein the first destination code is a first digit in a multi-digit number identifying a location within a predetermined delivery route.

16. A method according to claim 15, wherein the second destination code is a second digit in said multi-digit number.

17. A method according to claim 13, wherein a finally sorted and accumulated set of sheets is produced when said second sorting operation has been completed.

18. A method according to claim 13, wherein a predetermined number of sorting operations is performed until said sheets are in a sequence corresponding to predetermined locations along a delivery route.

19. A method according to claim 13, wherein said first sorting operation and said at least a second sorting operation are performed automatically.

20. A method according to claim 13, wherein said step of moving the sorted and accumulated sheets from said plurality of compartments in said accumulating means to said feed means is performed automatically.

* * * * *